US009242837B2

(12) United States Patent
Wang et al.

(10) Patent No.: US 9,242,837 B2
(45) Date of Patent: Jan. 26, 2016

(54) SYSTEM AND METHOD FOR CONTROLLING SEMI-ACTIVE ACTUATORS ARRANGED TO MINIMIZE VIBRATION IN ELEVATOR SYSTEMS

(71) Applicant: Mitsubishi Electronic Research Laboratories, Inc., Cambridge, MA (US)

(72) Inventors: Yebin Wang, Acton, MA (US); Scott A Bortoff, Brookline, MA (US)

(73) Assignee: MITSUBISHI RESEARCH LABORATORIES, INC., Cambridge, MA (US)

( * ) Notice: Subject to any disclaimer, the term of this patent is extended or adjusted under 35 U.S.C. 154(b) by 493 days.

(21) Appl. No.: 13/793,954

(22) Filed: Mar. 11, 2013

(65) Prior Publication Data

US 2014/0251734 A1 Sep. 11, 2014

(51) Int. Cl.
*B66B 1/24* (2006.01)
*B66B 7/04* (2006.01)

(52) U.S. Cl.
CPC ..... *B66B 7/043* (2013.01)

(58) Field of Classification Search
CPC ..... B66B 7/043
USPC ..... 187/247, 277, 292, 293, 391, 393, 406; 700/19, 32, 108, 280, 281, 283; 701/37, 48, 50; 702/54, 56
See application file for complete search history.

(56) References Cited

U.S. PATENT DOCUMENTS 5,289,902 A 3/1994 Fujita
5,329,077 A * 7/1994 Skalski ..... B66B 1/00 104/129
5,544,721 A * 8/1996 Roberts ..... B66B 7/046 187/292
5,712,783 A 1/1998 Catanzarite
5,866,861 A * 2/1999 Rajamani ..... B66B 7/044 187/292
7,401,683 B2 * 7/2008 Husmann ..... B66B 7/046 187/292
7,543,686 B2 * 6/2009 Kulak ..... B66B 7/044 187/292
7,621,377 B2 * 11/2009 Husmann ..... B66B 7/042 187/292
7,909,141 B2 * 3/2011 Utsunomiya ..... B66B 7/042 187/292
8,011,478 B2 9/2011 Utsunomiya
8,761,947 B2 * 6/2014 Wang ..... F16F 9/535 187/228
8,768,522 B2 * 7/2014 Wang ..... B66B 7/042 187/282
8,849,465 B2 * 9/2014 Wang ..... B66B 7/042 187/828
2012/0004777 A1 1/2012 Wang

FOREIGN PATENT DOCUMENTS

EP 0523971 A1 1/1993
EP 1985568 A1 10/2008

* cited by examiner

*Primary Examiner* — Anthony Salata
(74) *Attorney, Agent, or Firm* — Dirk Brinkman; Gene Vinokur

(57) ABSTRACT

A method controls a set of semi-active actuators arranged in an elevator system represented with a model of a virtual elevator system having a single virtual semi-active actuator arranged to compensate a virtual disturbance proportional to a sum of disturbances from the set of disturbances. The method determines the virtual disturbance during an operation of the elevator car using a motion profile of position of the elevator car during the operation and a disturbance profile of the virtual disturbance, and determines amplitude of a virtual force of the virtual semi-active actuator using the model and the virtual disturbance. A gain of a controller for controlling the set of semi-active actuators is adjusted based on the amplitude of the virtual force and a reference force of the virtual semi-active actuator.

16 Claims, 21 Drawing Sheets

100

702

900

SYSTEM AND METHOD FOR CONTROLLING SEMI-ACTIVE ACTUATORS ARRANGED TO MINIMIZE VIBRATION IN ELEVATOR SYSTEMS

FIELD OF INVENTION

This invention relates generally to controlling a set of semi-active actuators, and more particularly to controlling the set of semi-active actuators to minimize a vibration in an elevator system.

BACKGROUND OF INVENTION

Vibration reduction in mechanical systems is important for a number of reasons including safety and energy efficiency of the systems. Particularly, vibration in various transportation systems is directly related to ride quality and safety of passengers, and, thus, should be minimized. For example, vertical vibration in vehicles can be controlled by active or passive vibration reduction systems, which are generally referred as suspension systems. Similarly, the vibration induced during an operation of an elevator system can be minimized.

The elevator system typically includes a car, a frame, a roller guide assembly, and guide rails. The roller guides act as a suspension system to minimize the vibration of the elevator car. The car and roller guides are mounted on the frame. The car and frame move along the guide rail as constrained by the guide rollers. There are two principal disturbances which contribute to the levels of vibration in the car: (1) rail-induced forces which are transferred to the car through the rail guides due to rail irregularities, and (2) direct-car forces, such as produced by wind buffeting the building, passenger load, distribution or motion.

Some methods, e.g., methods described in U.S. Pat. Nos. 5,289,902, 5,712,783, 7,909,141,8,011,478, compensate for irregularity of the guide rail in the elevator system to improve the comfort of the ride. However, those methods do not consider uncertainties in the elevator components, for instance the parameters of a damping device changes over time due to aging, temperature, and thus reduce the effectiveness of the vibration reduction suspension system.

For example, U.S. Pat. No. 5,289,902 discloses a method to control actuators damping the vibration of the elevator car by comparing the frequency of a vibration signal to a pre-determined frequency. The pre-determined frequency is calibrated based on fixed values of parameters of the elevator and actuators.

Because parameters of the elevator and actuators may vary over time, new values of parameters may correspond to a different pre-determined value to maintain a desirable performance on vibration reduction. A controller that fails to acquire the variations of parameters deteriorates the performance of the method.

SUMMARY OF INVENTION

It is an objective of some embodiments of an invention to provide a system and a method for controlling a set of semi-active actuators arranged in an elevator system to compensate for a set of disturbances in a horizontal direction on an elevator car and to minimize the vibration of the elevator car. It is a further objective of some embodiments, to provide such system and method that maintains the performance of the control of the semi-active actuators while minimizing a number of sensors for measuring parameters of operation of the system. It is further objective of some embodiments of the invention to provide a method and a system for adjusting a gain of a controller for the set of semi-active actuators to compensate for the aging of the actuators.

Various embodiments of the invention determine a control policy of the semi-active actuators. To minimize the number of measured parameters, some embodiments determine a control policy based on a parameter representing the vibration of the system. An example of the parameter is an acceleration signal indicative of the acceleration of an elevator frame or an elevator car in the elevator system. Accordingly, some embodiments minimize the cost of the control by using, during the operation of the elevator system, only the measurements of the accelerometer.

Some embodiments determine the control policy based on a model of the elevator system. The embodiments take advantage of a realization that a set of semi-active actuators can be controlled uniformly and thus a model of the elevator system can be simplified based on that uniformity. Accordingly, some embodiments represent the elevator system as a model of a virtual elevator system having a single virtual semi-active actuator arranged to compensate a virtual disturbance.

The virtual semi-active actuator represents the set of semi-active actuators. For example, a compensative force of the virtual semi-active actuator represents compensative forces of the set of semi-active actuators. Similarly, the virtual disturbance represents a combination of the set of disturbances. Such realization allows defining the control policy for the virtual semi-active actuator, and controlling uniformly each actuator of the set of semi-active actuators according to the control policy of the virtual semi-active actuator. In addition, such realization allows tuning control of the set of semi-active actuators by tuning gains of the control of the virtual semi-active actuator.

Some embodiments are based on another realization that virtual vibration can be determined in advance using the model of the virtual elevator system and an acceleration signal indicative of a horizontal acceleration of the elevator car. For example, one embodiment augments the model with the virtual disturbance and a time derivative of the virtual disturbance as state variables and inverts the augmented model to determine a relationship between a second order time derivative of the virtual disturbance and the acceleration signal. Based on this relationship and the measurements of the acceleration signal the virtual disturbance can be determined.

Accordingly, various embodiments receive values of the acceleration signal measured at different vertical positions of the elevator car during an operation of the elevator system without usage of the set of actuators and determine, based on the model and the values of the acceleration signal, the vertical profile of the virtual disturbance. The vertical profile maps values of the virtual disturbance to corresponding vertical positions of the elevator car.

During operation of the elevator car, the disturbance profile of the virtual disturbance can be used to determine the virtual disturbance for the operation. For example, one embodiment determines the virtual disturbance during the operation of the elevator car using a motion profile of a movement of the elevator car during the operation and the disturbance profile of the virtual disturbance. The disturbance profile is predetermined and stored in a memory accessible by a processor of a control system. The motion profile of a position of the elevator car can be, e.g., determined by a motion controller of the elevator system. Such embodiment can be advantageous because allows to incorporate future disturbance in the control policy.

Some embodiments are based on another realization that given the virtual disturbance, an amplitude of a virtual force of a virtual semi-active actuator, reflecting the variation of semi-active actuators, can be determined using the model of the virtual elevator system and an acceleration signal indicative of a horizontal acceleration of the elevator car. Given the amplitude of the virtual force and the amplitude of a reference virtual force, a gain of a controller of the virtual semi-active actuator can be adjusted to compensate the deviation of the amplitude of the virtual force from that of the reference virtual force.

For example, one embodiment treats the virtual force of the virtual semi-active actuator as an unknown input variable and provides an estimation of the virtual force by inverting the virtual system as an inverse system, where the input is the acceleration signal and output is the estimated virtual force.

Some embodiments are based on another realization that given a virtual disturbance, the amplitude of the virtual force of the virtual semi-active actuator can be determined by parameterizing the virtual force as a product of the amplitude and the virtual relative velocity of the virtual relative velocity, which can be estimated from acceleration signals and the virtual system, thus is treated as a known signal. Thus the virtual system has a linear parameterization of the unknown constant: the amplitude of the virtual force. A linear adaptive estimator can be applied to identify the amplitude of the virtual force.

Accordingly, one embodiment discloses a method for controlling a set of semi-active actuators arranged in an elevator system to minimize a vibration of an elevator car caused by a set of disturbances in a horizontal direction on the elevator car moving in a vertical direction. The method includes representing the elevator system with a model of a virtual elevator system having a single virtual semi-active actuator arranged to compensate a virtual disturbance proportional to a sum of disturbances from the set of disturbances, wherein a compensative force of the virtual semi-active actuator is proportional to a sum of compensative forces of the set of semi-active actuators; determining the virtual disturbance during an operation of the elevator car using a motion profile of position of the elevator car during the operation and a disturbance profile of the virtual disturbance; determining an amplitude of an virtual force of the virtual semi-active actuator using the model and the virtual disturbance; and adjusting a gain of a controller for controlling the set of semi-active actuators based on the amplitude of the virtual force and a reference force of the virtual semi-active actuator. Steps of the method are performed by a processor.

Another embodiment discloses a system for controlling a set of semi-active actuators arranged in an elevator system to compensate for a set of disturbances. The system includes a sensor for determining an acceleration signal indicative of a horizontal acceleration of the elevator car during an operation of the elevator system; a virtual disturbance module for determining a virtual disturbance using a motion profile of position of an elevator car during an operation of the elevator system and a disturbance profile of the virtual disturbance; a controller for controlling each actuator of the set of semi-active actuators according to a control policy of the virtual semi-active actuator using the disturbance profile of the virtual disturbance and the acceleration signal measured during the operation of the elevator car with usage of the set of actuators; an amplitude estimator for determining an amplitude of an virtual force of the virtual semi-active actuator using the model and the virtual disturbance; and a tuning module for adjusting a gain of a controller for controlling the set of semi-active actuators based on the amplitude of the virtual force and a reference force of the virtual semi-active actuator.

DETAILED DESCRIPTION OF EMBODIMENTS OF INVENTION

Various embodiments of the invention disclose a system and a method to control an elevator system having semi-active actuators. Some embodiments are directed to a suspension system subject to at least one external disturbance in a direction of a disturbance, and at least one semi-active actuator is controlled to minimize the vibration of one of masses induced by the corresponding disturbances.

For clarity, this disclosure focuses on the control method of a system using semi-active actuators to minimize vibration induced by disturbances in one direction, and the system is subject to external disturbances in that direction. A control method to minimize vibration in multiple directions can be derived by generalizing the disclosed control method.

Given a set of disturbances and a set of semi-active actuators, some embodiments of the invention represent the system as a model of a virtual system having a single virtual semi-active actuator arranged to compensate a virtual disturbance. For example, a compensative force of the virtual semi-active actuator represents compensative forces of the set of semi-active actuators, and the virtual disturbance represents a combination of the set of disturbances. In various embodiments, such representation is based on assumption of uniformity of the semi-active actuators, i.e., all semi-active actuators are exactly the same, perform, and are controlled in a similar way.

In various embodiments of the invention, control of semi-active actuators is derived according to an optimal control theory and is based on the model of the system. In some embodiments, the model of the system is represented by a model of a virtual system. For example, one embodiment controls uniformly each actuator of the set of semi-active actuators according to an optimal control policy of the virtual semi-active actuator. Specifically, some embodiments are based on a realization that it is advantageous to control the set of actuators according to the optimal control policy that optimizes parameter of operation of the system.

Figure 1A:
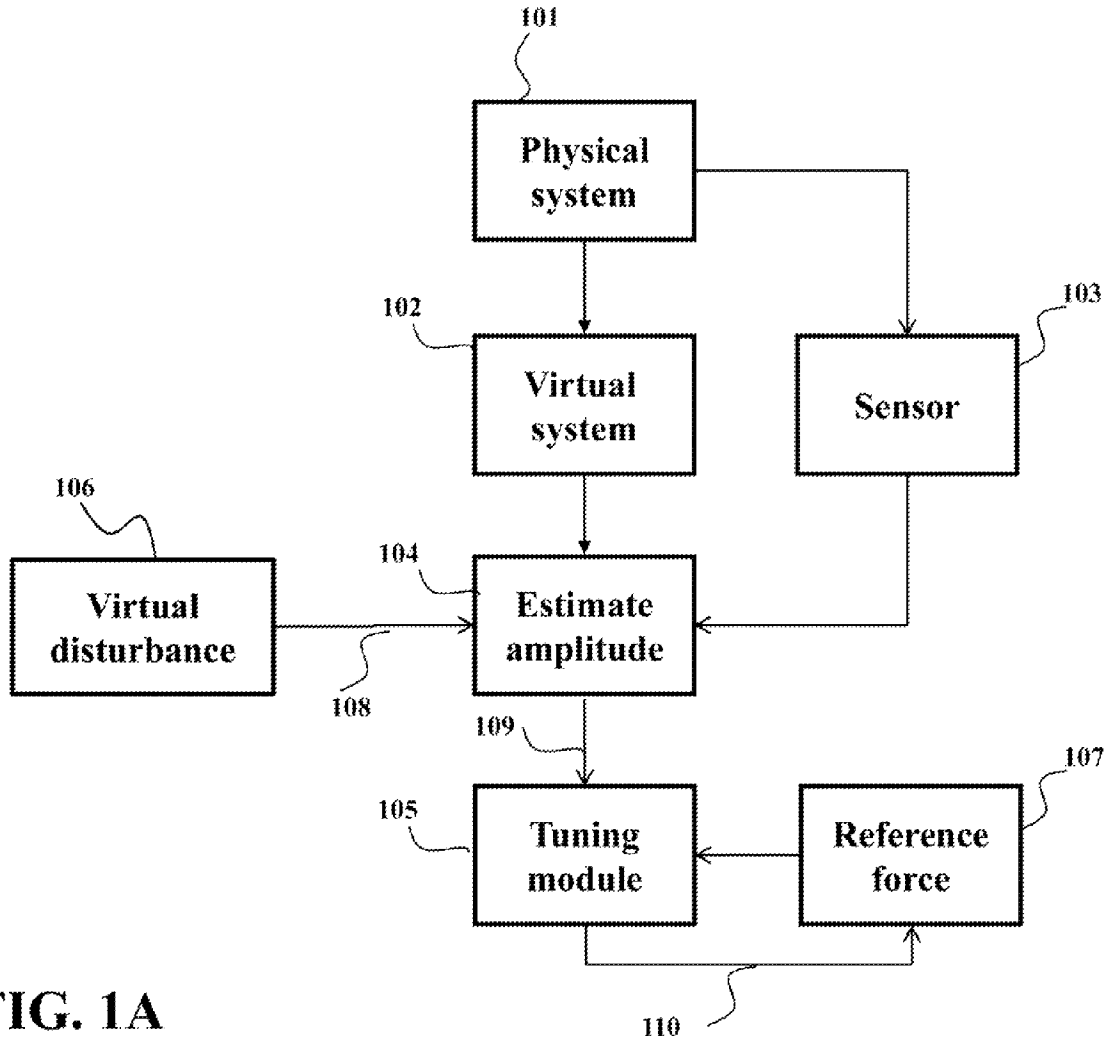
FIGS. 1A, 1B, and 1C are block diagrams of a control method according to some embodiments of an invention.
Figure 1B:
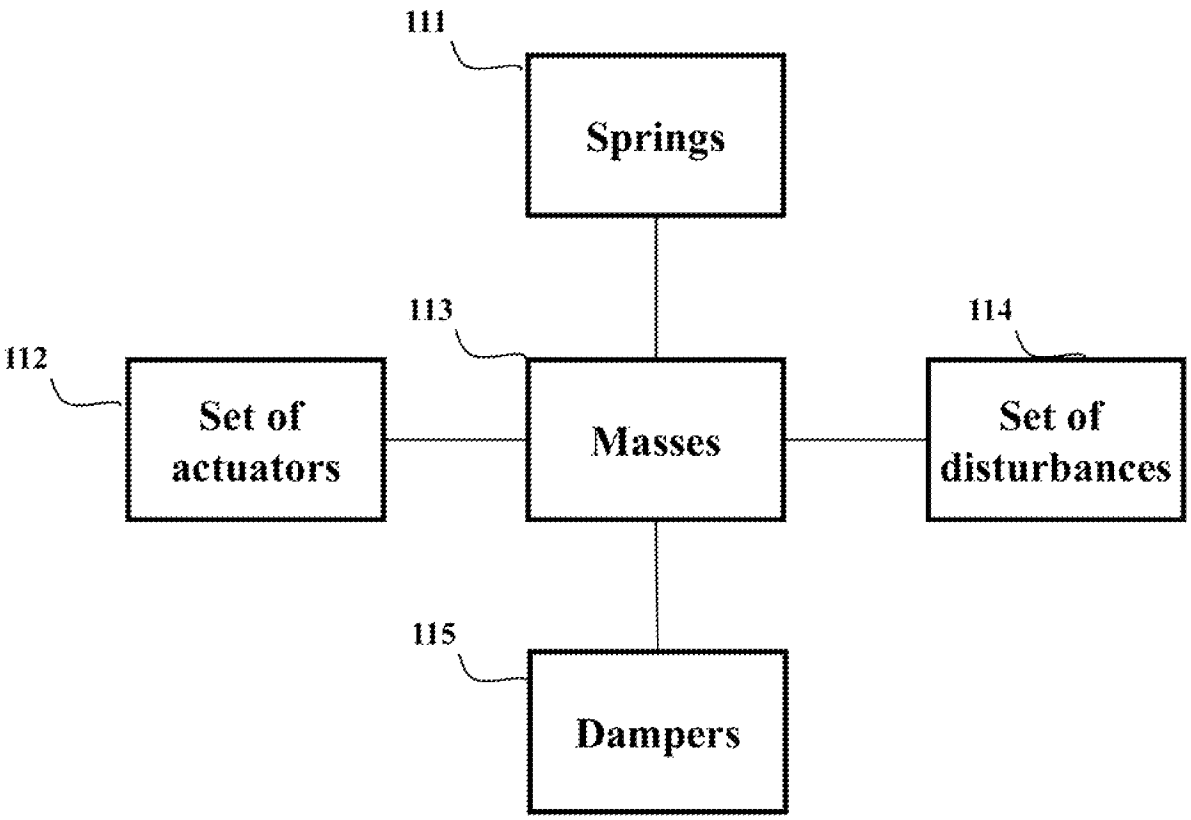
Figure 1C:
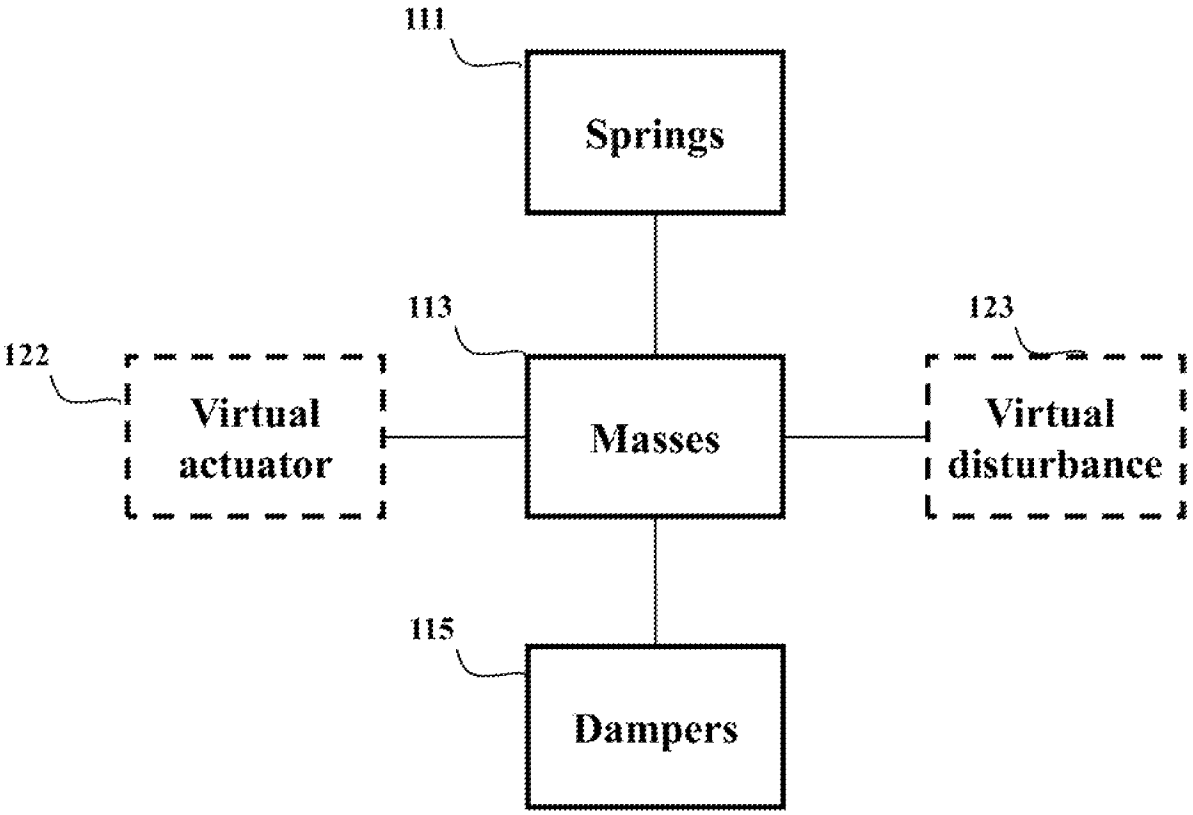

FIG. 1A shows a schematic of a system and method for controlling a set of semi-active actuators to compensate uncertain gains of the semi-active actuators. The control method starts with a representation of a model of a physical system 101. FIG. 1B shows an example of the model, including one or a combination of masses 113, springs 11, dampers 115, and a set of semi-active actuators 112. The system is subject to a set of disturbances 114. In one embodiment, the system 101 is represented as a model of a virtual system 102 based on the assumption that all relevant semi-active actuators are exactly the same and perform uniformly. As shown in FIG. 1C, the virtual system includes one or combination of the masses 113, the springs 111, and the dampers 115. The virtual system also includes a virtual semi-active actuator 122, and is subject to a virtual disturbance 123. This invention teaches control methods based on the virtual system, but not necessarily limited to the virtual system.

The disturbances affect the movement of masses in one direction. One virtual disturbance in a specific direction represents the combined effect of all relevant disturbances on the movement of the masses in that direction. Similarly, a virtual actuator corresponding to a virtual disturbance in a specific direction accounts for the effect of all relevant semi-active actuators on the masses in that specific direction.

Sensors 103 measure a signal indicating an operational status of the system 101. Given the model of the virtual system, and a virtual disturbance 108 of the virtual semi-active actuator, an estimate amplitude module 104 determines amplitude of a virtual force 109 that the virtual semi-active actuator generates during the operation. Given the amplitude 109, a tuning module 105 determines a gain 110 of a controller for controlling the semi-active actuators. The gain 110 is determined based on the amplitude 109 and the amplitude of a reference force 107 determined during the previous iteration of the method 100. The gain 110 can also be used updating the reference force 107 for subsequent iterations of the method 100. The control signal can vary either the voltage or current. The signal can be directly outputted to the semi-active actuators 112, or indirectly via amplifiers.

As shown in FIGS. 1B-1C, the difference between the physical system and the virtual system is the presence of the virtual actuator and virtual disturbance in the virtual system. One embodiment, in order to determine the virtual system, determines the virtual disturbances and the virtual semi-active actuator. Under the assumption that all semi-active actuators corresponding to the movement of one mass in a specific direction perform uniformly, all disturbances affecting the movement of the mass in the specific direction can be combined as a virtual disturbance, and the effect of all corresponding semi-active actuators on the mass in the specific direction can be characterized by a virtual semi-active actuator which is mounted between the mass and the source of the virtual disturbance.

Figure 2:
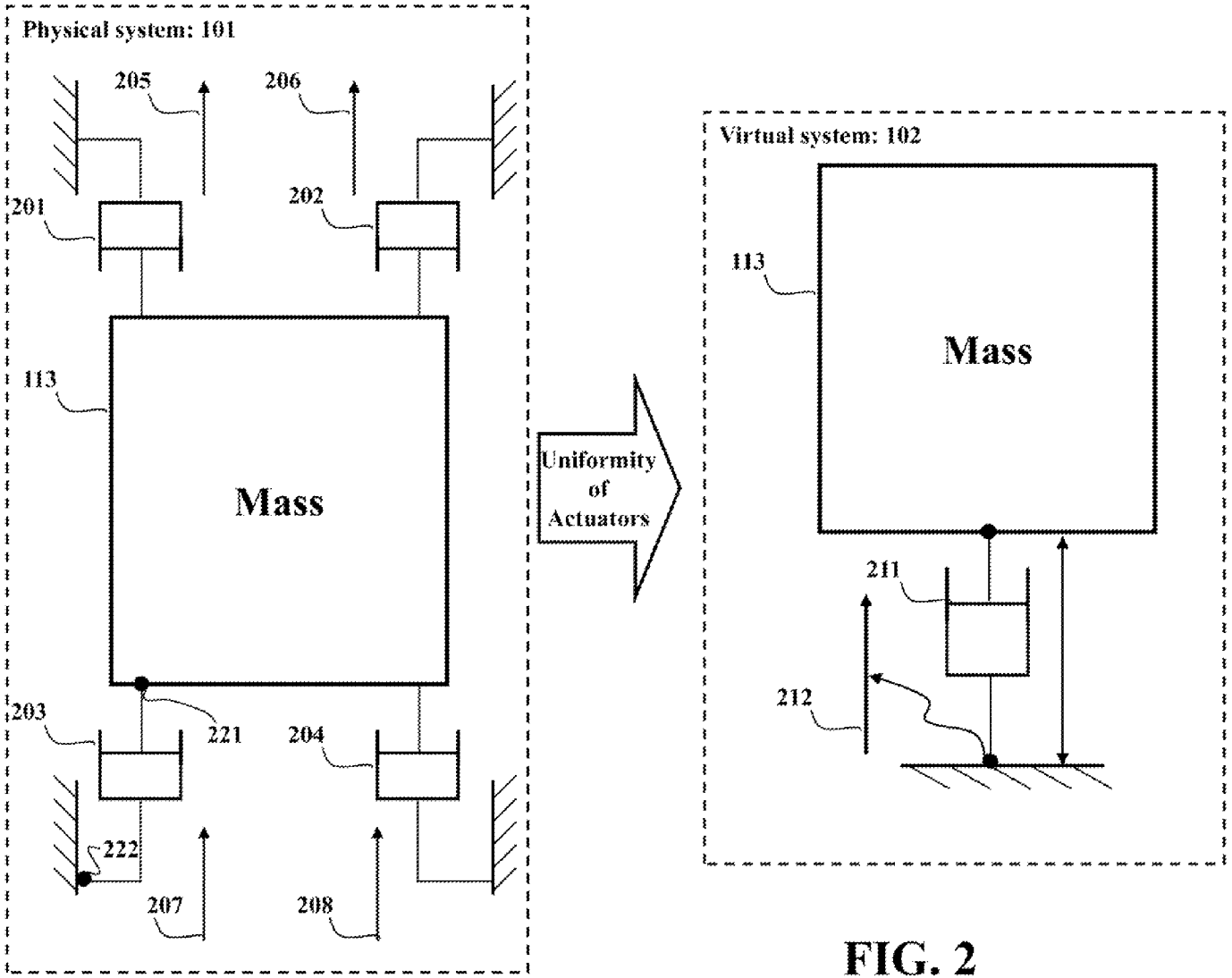
FIG. 2 is a schematic of determining a model of a virtual system including a virtual actuator according to some embodiments of the invention.

FIG. 2 shows an example of the physical system disturbed by four external disturbances $w_1$, $w_2$, $w_3$, $w_4$ in the vertical direction, denoted by 205, 206, 207, and 208, respectively. The set of semi-active actuators 201, 202, 203, 204 are mounted on the same mass 113 to compensate for the set of disturbances. Particularly, the first ends of four semi-active actuators, e.g., a first end 221, are mounted on the mass 113, and the second ends of four semi-active actuators, e.g., a second end 222, are mounted on corresponding sources of the disturbances $w_1$, $w_2$, $w_3$, $w_4$ respectively.

For example, in some embodiment each semi-active actuator is a semi-active damper having a controlled damping coefficient $u_i$, $1 \le i \le 4$ Assuming that all semi-active actuators are controlled uniformly, the physical system is minimized to a virtual system with a virtual disturbance 212 and the virtual semi-active actuator 211. Particularly, the virtual disturbance is a sum of four disturbances, and denoted as $$\bar{w} = \frac{1}{\sum_{i=1}^{4} u_i} \sum_{i=1}^{4} u_i w_i.$$

The virtual semi-active actuator has a controlled damping coefficient of $$\bar{u} = \sum_{i=1}^{4} u_i.$$

For the embodiment with all the semi-active actuators having the same controlled damping coefficients, the virtual semi-active actuator has a controlled damping coefficient $\bar{u}=4u_1$, and the virtual disturbance is $$\bar{w} = \frac{1}{4} \sum_{i=1}^{4} w_i.$$

Without loss of generality, all k semi-active actuators, a type of damping device, are applied on the same mass m with a displacement x. Hence, the $i^{th}$ semi-active actuator generates a compensating force of $f_i = u_i(\dot{x} - \dot{w}_i)$ where $u_i$ is the controlled damping coefficient of the ith semi-active actuator. The compensating forces of the set of semi-active actuators are $$f = \sum_{i=1}^{k} u_i(\dot{x} - \dot{w}_i), \tag{1}$$

where the dots above the variables indicate derivatives.

In one embodiment, the semi-active actuators perform uniformly, and the semi-active actuators have the same controlled damping coefficients, the compensating forces of all semi-active actuators is $$f = u \sum_{i=1}^{k} (\dot{x} - \dot{w}_i) = ku\left(\dot{x} - \frac{1}{k} \sum_{i=1}^{k} \dot{w}_i\right), \tag{2}$$

based on which a virtual semi-active actuator generates the same compensating force as all k semi-active actuators can be determined. For example, the controlled damping coefficient of the virtual semi-active actuator is ku, the virtual relative velocity of the virtual semi-active actuator is $$\dot{x} - \frac{1}{k} \sum_{i=1}^{k} \dot{w}_i,$$

and the virtual disturbance is $$\frac{1}{k} \sum_{i=1}^{k} \dot{w}_i.$$

Figure 3:
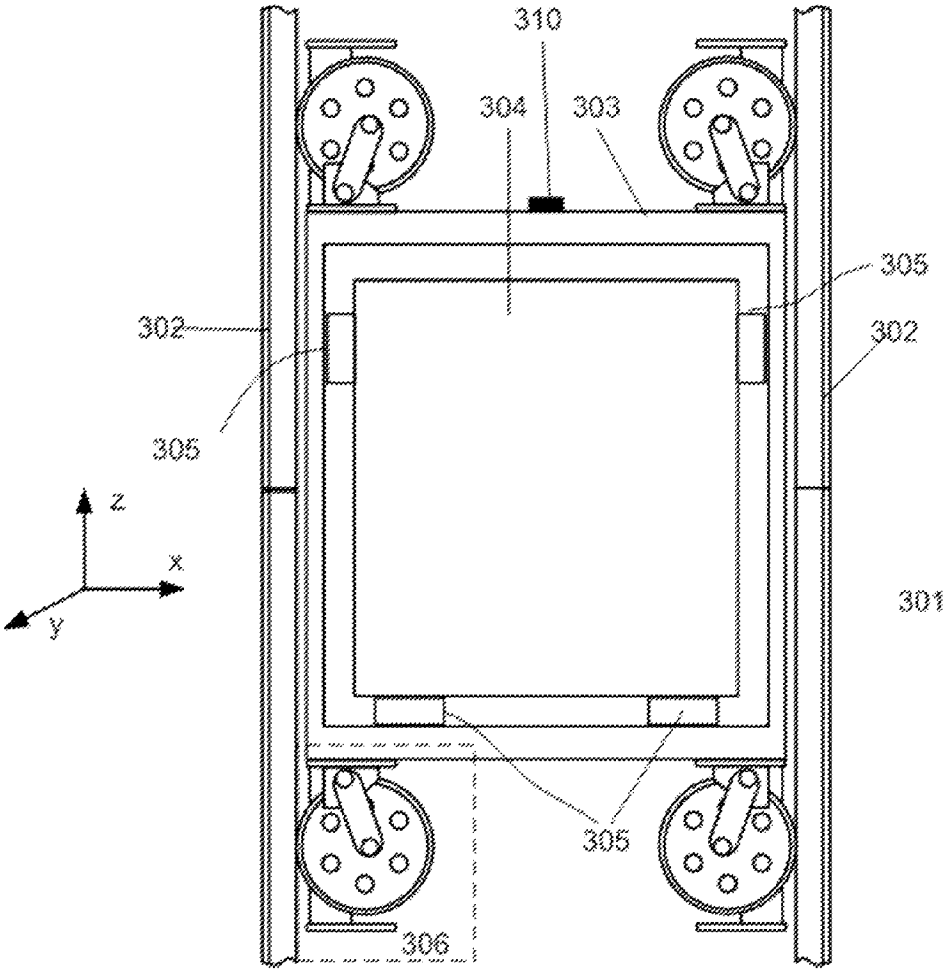
FIG. 3 is a schematic of an elevator system according to some embodiments of the invention.

FIG. 3 shows an example of a portion of an elevator system including two guide rails 302, a frame 303, a car 304, four car support rubbers 305, and four roller guides 306. In this not limiting example, each roller guide includes three rollers 401 (center roller, front roller, and back roller), and three rotation arms 405 corresponding to three rollers. The elevator system includes four center, front, and back rollers respectively. The guide rails 302 are installed vertically (z-axis) in an elevator hoistway 301. The frame 303 supports the car 304 via the vibration isolating rubbers 305. The frame can move vertically in the hoistway of the elevator shaft. A roller guide 306 guides the movement of the frame 303 along guide rails 302.

Figure 4:
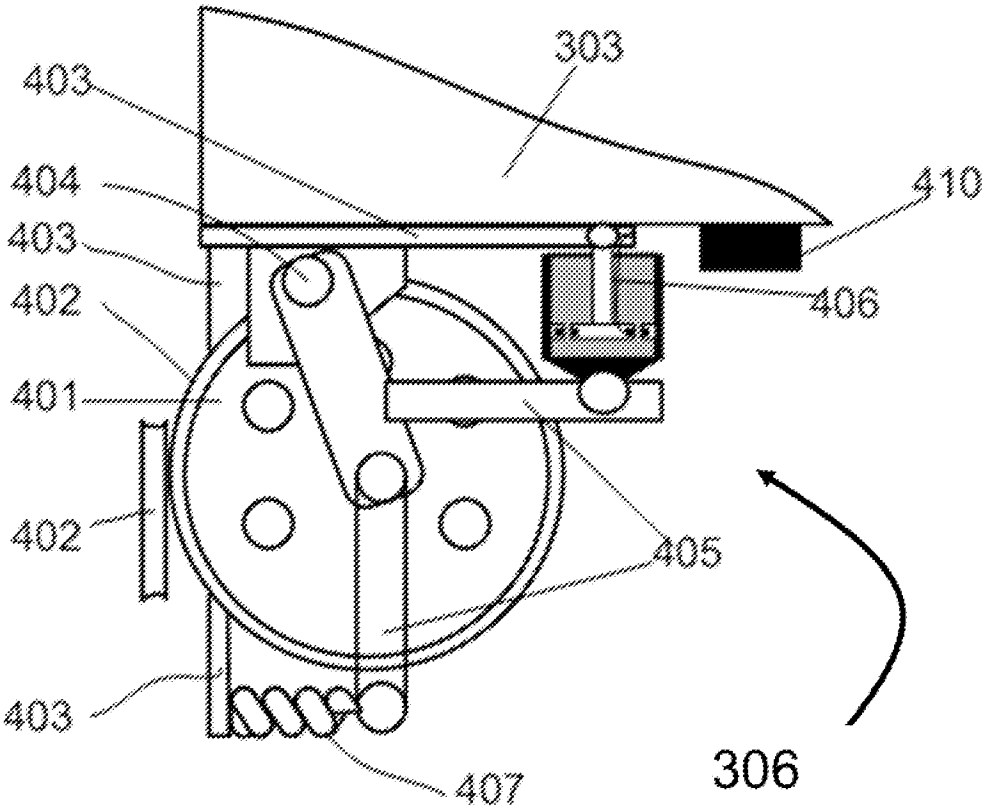
FIG. 4 is a schematic of a roller guide assembly with a semi-active actuator installed on a center roller according to some embodiments of the invention.

FIG. 4 shows a part of a roller guide assembly 306 with a center roller 401 serving to minimize the vibration of the elevator car in the right-to-left direction (x-axis). As shown in FIG. 4, the center roller 401 maintains contact with the guide rail 302 through a roller gum 402. The roller is mounted on a base 403 of the frame, and can rotate around a pivot 404 whose axis is along a front to back direction (y-axis). A rotation arm 405 rotates at the same angular velocity as the roller around the pivot 404. In one embodiment, a semi-active actuator 406 is installed between the frame base 403 and the rotation arm 405. A roller spring 407 is installed between the rotation arm 405 and the frame base 403.

Referring back to FIG. 3, the level variation of the guide rails causes the rotation of the roller around the pivot. The rotation of the roller induces the lateral movement of the frame due to a coupling between the rotation arm and the frame base through the roller spring, i.e. the level variation of the guide rails is a source of the disturbances. The lateral movement of the frame further induces the movement of the car by their coupling 305. The elevator car moves in front to back (y-axis) and/or left to right (x-axis) directions. Damping devices between the roller and the frame, or the frame and the car, can control the lateral vibration of the car.

A semi-active actuator is installed between one end of the rotation arm and the base. The semi-active actuator generates a force based on a relative lateral movement between the rotation arm and the frame. This force can remove the energy transferred to the frame, and thus damp the vibration of the frame. Consequently, the vibration of the elevator car is minimized.

According to various embodiments of the invention, the elevator system also includes a sensor 310 for measuring a parameter representing a vibration level of the elevator car during the operation of the elevator system. For example, an acceleration of the elevator affects how comfortable the passengers feel, thus the sensor 310 can be an accelerometer for measuring an acceleration of the elevator frame 303 or for measuring directly the acceleration of the elevator car 304. In some embodiments, the semi-active actuators 306 are controlled, e.g., by a controller 410, according to the control policy based on the measured signal during the operation of the elevator system. In one embodiment, the acceleration of the elevator frame is measured to reduce the number of sensors, and the cost of the system.

In one embodiment, the roller guide assembly includes a rheological actuator arranged between the base and the rotation arm as shown in FIG. 4. The rheological actuator can include a magneto-rheological (MR) fluid, or an electro-theological (ER) fluid. Generally, flow characteristics of the rheological fluid can be actuated by a magnetic or an electrical signal. Due to the linear relative velocity between the frame and the end point of the rotation arm, the frame vibration is minimized by selectively adjusting the damping coefficient of the linear MR actuator according to the feedback signal. In another embodiment, actuators generating damping forces based on Coulomb friction can be mounted to the roller guide assembly to control the movement of the elevator system.

In the case of the MR actuator, the controller can selectively turn the MR actuators ON or OFF in response to the vibrations, and output the corresponding signal to the amplifier. To turn the MR actuator ON, the amplifier outputs an electric current to the coil of the MR actuator. The coil current establishes the required magnetic field to increase the viscosity of MR fluids inside the housing of the MR actuator, thus change the damping coefficient of the MR actuator. To turn the MR actuator OFF, no current is output by the amplifier, thus the damping coefficient of the MR actuator is minimal. In another embodiment, the MR actuator can be turned on continuously, i.e., the controller continuously adjusts the damping coefficient of the MR actuator.

There are numerous variations configuration of assembling semi-active actuators with the elevator system. In one embodiment, one semi-active actuator is installed for each roller. Considering the purpose of the semi-active suspension to minimize the acceleration of the floor of the elevator car, the semi-active actuators installed on the lower roller guide assembly play major impact on the achievable vibration reduction performance. Hence, another embodiment uses six semi-active actuators over the two lower roller guides. Further reduction of the number of semi-active actuators is possible. For example, one embodiment uses only four semi-active actuators, two over the lower center rollers, one over the lower left front roller, and one over the lower right front roller. Another embodiment is to use two semi-active actuators: one over a lower center roller to damp left-to-right movement, and the other over a lower front or back roller to damp front-to-back movement.

In one embodiment satisfying the aforementioned symmetry condition, the elevator suspension includes eight semi-active actuators, i.e., one semi-active actuator is installed on the center roller of each roller guide, and one semi-active actuator is installed on the front roller of each roller guide. Even if the symmetry condition is not strictly satisfied, for some embodiments, the established virtual system by simplification can still represent the physical system fairly well when the physical system is close to symmetry. Methods taught here should not be limited to applications in physical systems satisfying the symmetry condition.

For example, one embodiment provides the control method of the semi-active scheme for the full elevator system, where eight semi-active actuators are installed on four roller guides, i.e., one semi-active actuator for each center roller, and one semi-active actuator for each front roller. An example of the configuration of the semi-active actuator on a roller of an elevator is shown in FIG. 4. Various embodiments of this invention determine the virtual system, determine the disturbance profile and estimated virtual disturbance, design the state estimator, and control law, which does not necessarily strictly satisfy the symmetry condition. Some notations used in this disclosure are given in Table 1.

TABLE 1

Notations

| Notation | Description |
|---|---|
| x-axis | right to left movement |
| y-axis | back and forth movement |
| z-axis | vertical movement |
| $x_c$, $x_f$ | x-axis movement of the car and the frame |
| $\theta_c^y$, $\theta_f^y$ | y-axis rotation of the car and the frame |
| $\theta_r^{yi}$ | y-axis rotation of the ith rotation arm |
| $m_c$, $m_f$ | the masses of the car and the frame |
| $I_c^y$, $I_f^y$ | the inertia of the car and the frame around the y-axis |
| $k_c^x$ | weighted stiffness of car-hold rubber (right to left direction) |
| $b_c^x$ | weighted damping of car hold rubber (right to left direction) |
| $k_g^x$ | the stiffness of a roller gum (right to left direction) |
| $b_g^x$ | the damping coefficient of a roller gum (right to left direction) |
| $l_c^y$ | Vertical displacement between the force $f_c^x$ and the mass center of the car |
| L | length between arm pivot and actuator force point |
| $R_l$ | height between arm pivot and the point where the roller contacts the rail |

TABLE 1-continued

| Notations | |
|---|---|
| Notation | Description |
| $h_l$ | height between arm pivot and the roller spring |
| $l_f^{yi}$ | height between the frame center of mass and the point where the ith roller contacts the rail |
| $w_i^x$ | the disturbance applied on the ith roller in x-axis |
| $u_i^x$ | the damping coefficient of the actuator installed on the ith roller |

The car and frame movement in the right-to-left direction or in x-axis, and the car and frame movement in the back-to-forth direction or in y-axis are decoupled.

One embodiment considers the control method for semi-active actuators to minimize the vibration of the elevator in the right-to-left direction.

Figure 5A:
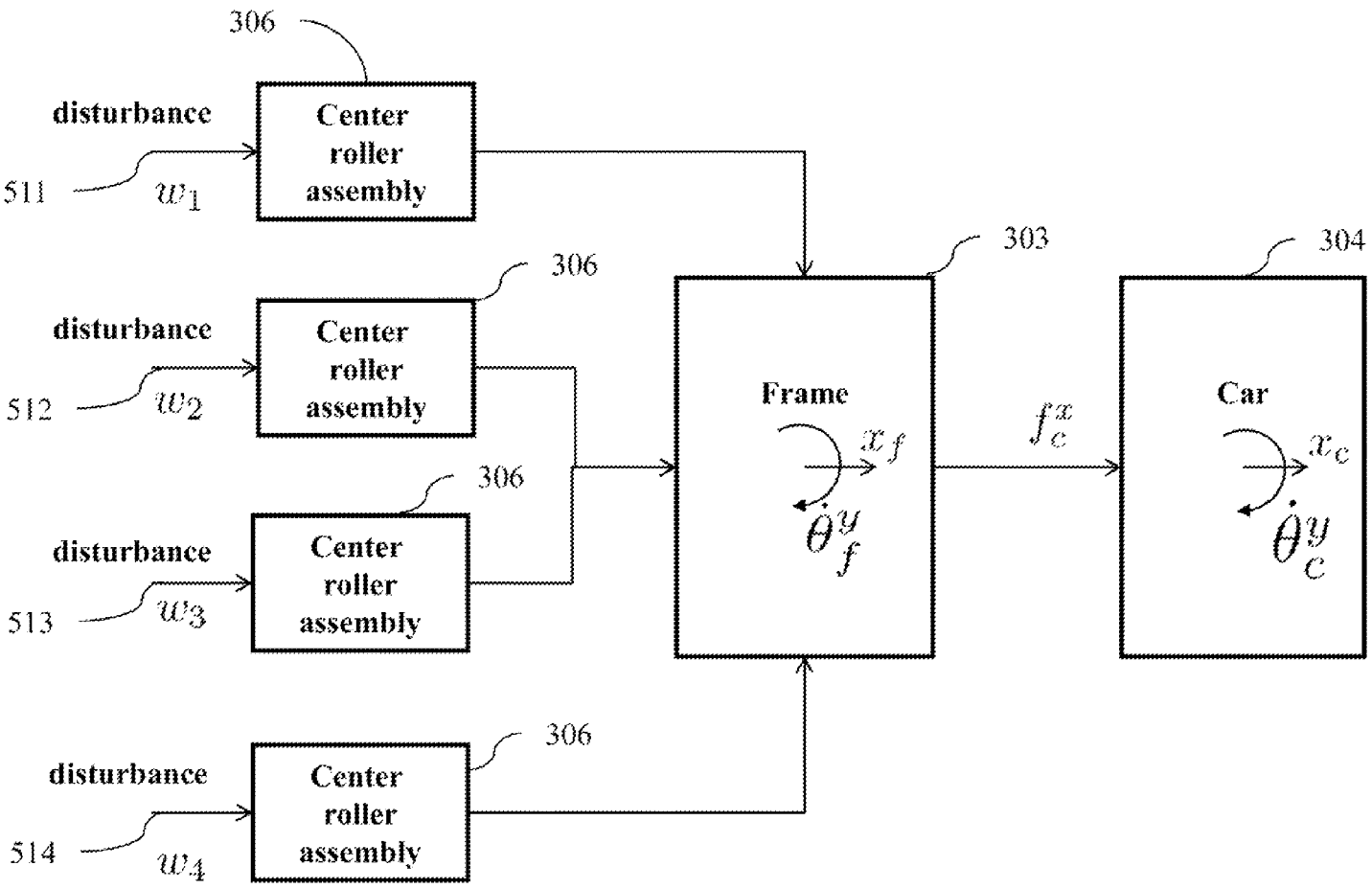
FIGS. 5A and 5B are schematics of disturbances of the elevator system of FIG. 3.

FIG. 5A shows a schematic of exemplar disturbances of the elevator system. In this example, the elevator system is subject to four disturbances, 511, 512, 513, and 514, in the right-to-left direction. The four disturbances are applied to the elevator system through four center roller assemblies 306, and can result in the translational movement of frame 303 in the right-to-left direction, and the rotation of the frame around the y-axis. The translation and rotation of the frame further excite the translation and rotation of the car 304 in the right-to-left direction and around the y-axis respectively. The right-to-left movement of the car and the frame are coupled with the rotation of the car and the frame around the y-axis. This embodiment gives the dynamics of movements of the car and the frame in the x-axis, the rotations of the car and the frame around y-axis, and the rotation of the four center rollers. The rest of dynamics can be similarly derived but are irrelevant to minimize the vibration in the right-to-left direction.

The control method can be implemented by the controller 410 based on the parameter representing an acceleration of the elevator car measured by the sensor 310. The controller controls the set of semi-active actuators according to various control policies of a virtual semi-active actuator representing the set of actuators, as described later.

The elevator car can be subject to various forces result from the interaction with the frame. These forces can include the spring and damping forces resulting from support rubbers between the car and the frame, which is denoted by a combined force $f_c^x$, and written as $$f_c^x = k_c^x(x_c - x_f + l_c^y(\theta_c^y - \theta_f^y)) + b_c^x(\dot{x}_c - \dot{x}_f + l_c^y(\dot{\theta}_c^y - \dot{\theta}_f^y)). \tag{3}$$

Similarly, the rotation of the car around the y-axis is induced by the combined torque, corresponding to the lumped force $f_c^x$, denoted by $$T_c^x = l_c^y f_c^x. \tag{4}$$

The translational movement of the frame including the frame and all roller guides in x-axis is subject to the forces from its interaction with the car and the guide rails, all of which are type of spring and damping forces. The lumped spring and compensating force result from the roller gums of four center rollers is denoted by $f_g^x$ and written as $$f_g^x = \sum_{i=1}^{4} f_g^{xi}, \tag{5}$$

$$f_g^{xi} = k_g^x(x_f + R_1\theta_r^{yi} + l_f^{yi}\theta_f^y - w_i^x) + b_g^x(\dot{x}_f + R_1\dot{\theta}_r^{yi} + l_f^{yi}\dot{\theta}_f^y - \dot{w}_i^x), \tag{6}$$

where $f_g^{xi}$ represents the spring and damping forces result from the roller gum of the ith center roller. Hence, the dynamics of the frame translation in the right-to-left direction is $$(m_f + m_r)\ddot{x}_f + \sum_{i=1}^{4} p_2^{xi}\ddot{\theta}_r^{yi} - f_c^x + f_g^x = 0, \tag{7}$$

where $p_2^{xi}$ is an appropriate constant.

The roller is subject to the torque corresponding to forces result from the interaction between the roller gum and the guide rail, which is denoted by $$T_g^x = \sum_{i=1}^{4} T_g^{xi},$$

$$T_g^{xi} = R_1 f_g^{xi}.$$

The torque, around the pivot arms, corresponding to the spring and damping forces of the roller spring, is denoted by $$T_r^x = \sum_{i=1}^{4} T_r^{xi},$$

$$T_r^{xi} = h_1(k_r^x h_1\theta_r^{yi} + b_r^x h_1\dot{\theta}_r^{yi}).$$

The torque corresponding to the compensating force of semi-active actuators is $$T_u^x = \sum_{i=1}^{4} T_u^{xi},$$

$$T_u^{xi} = L^2 u_i^x \dot{\theta}_r^{yi}.$$

The dynamics of the elevator including the translation and rotation of the car and the frame in the right-to-left direction, and the rotation of the center rollers around their pivots are $$m_c\ddot{x}_c + f_c^x = 0, \tag{8}$$

$$I_c^y\ddot{\theta}_c^y + T_c^x = 0, \tag{9}$$

$$(m_f + m_r)\ddot{x}_f + \sum_{i=1}^{4} p_2^{xi}\ddot{\theta}_r^{yi} - f_c^x + f_g^x = 0, \tag{10}$$

$$p_2^{xi}\ddot{x}_f + p_3^{xi}\ddot{\theta}_f^y + I_r^y\ddot{\theta}_r^{yi} + T_g^{xi} + T_r^{xi} + T_u^{xi} = 0, \quad 1 \le i \le 4, \tag{11}$$

wherein $p_3^{xi}$ are constant, and $I_r^y$ is the inertial of the rotation arm and center roller with respect to the pivot.

In one embodiment, the coupling terms $p_2^{xi}\ddot{\theta}_r^{yi}$ and $p_2^{xi}\ddot{x}_f$ are ignored because the rest terms in the dynamics is dominant. Thus, the physical system model represented by Equations (8)-(11) can be simplified by considering $p_2^{xi}=0$, $p_3^{xi}=0$.

The virtual system is determined by manipulating the dynamics of the physical system. With the assumption that all semi-active actuator perform uniformly, the summation of Equation (11) for $1 \le i \le 4$ is $$I_r^y \sum_{i=1}^{4} \ddot{\theta}_r^{yi} + T_g^x + T_r^x + T_u^x = 0, \tag{12}$$

which allows the definition of a virtual semi-active actuator with a damping coefficient $$u = \frac{1}{4}\sum_{i=1}^{4} u_i^x = u_i^x,$$

a virtual disturbance $$w^x = \sum_{i=1}^{4} w_i^x,$$

and a corresponding virtual relative velocity $$\dot{\theta}_r^y = \sum_{i=1}^{4} \dot{\theta}_r^{yi}.$$

Figure 5B:
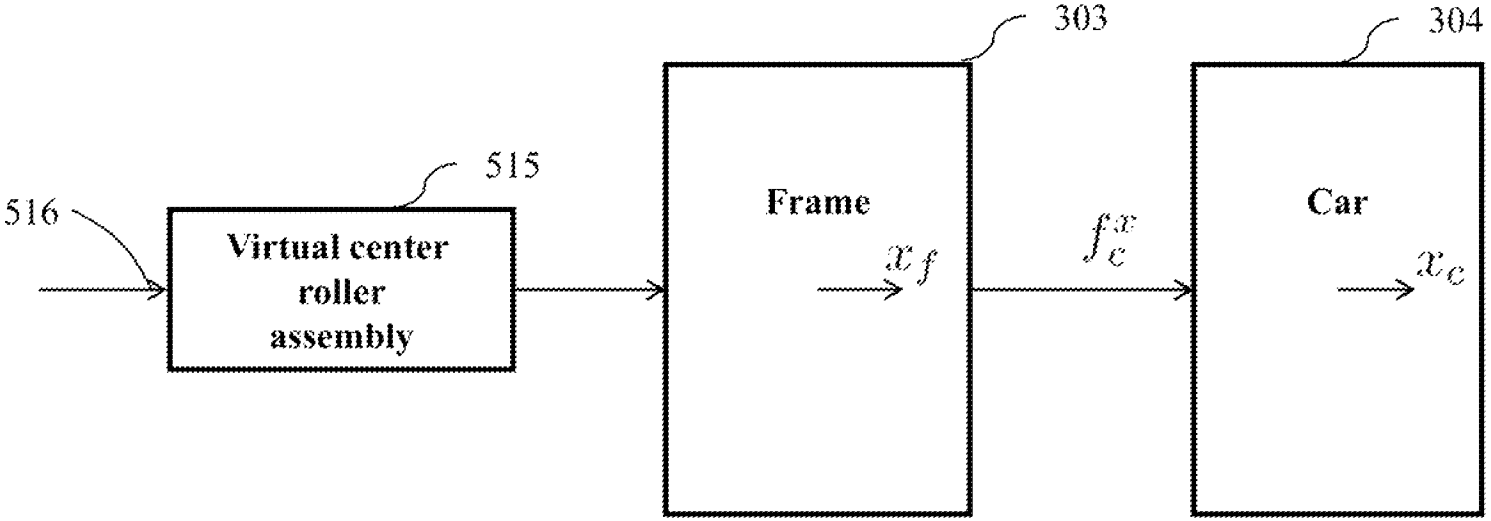

Thus, the virtual system is derived and shown in FIG. 5B, which includes the virtual disturbance 516, the virtual center roller assembly 515 including the virtual semi-active actuator, the frame 303, and the car 304. The virtual system is described by the following differential equations $$m_c\ddot{x}_c + f_c^x = 0, \tag{8*}$$

$$(m_f + m_r)\ddot{x}_f - f_c^x + f_g^x = 0, \tag{10*}$$

$$I_r^y\ddot{\theta}_r^y + T_g^x + T_r^x + T_u^x = 0, \tag{11*}$$

$$y = \ddot{x}_f, \tag{12*}$$

which can be further written as the following state space form $$\dot{x} = Qx + B_1 a\dot{\theta}_r^y + B_2(t),$$

$$y = Cx + D_1 a\dot{\theta}_r^y + D_2(t).$$

where Q, $B_1$, C, $D_1$ are appropriate known constant matrices, a is an unknown constant to be estimated, $x=(x_c, \dot{x}_c, x_f, \dot{x}_f, \theta_r^y, \dot{\theta}_r^y)$, and $B_2$, $D_2$ are known matrices comprising of known signals depending on the virtual disturbance and its time derivative. In one embodiment, the semi-active actuator generates force based on Coulomb friction, and the virtual system is written as follows $$\dot{x} = Qx + B_1 a\,\mathrm{sgn}(\dot{\theta}_r^y) + B_2(t),$$

$$y = Cx + D_1 a\,\mathrm{sgn}(\dot{\theta}_r^y) + D_2(t).$$

where sgn is the sign function as follows $$\mathrm{sgn}(\varepsilon) = \begin{cases} 1, & \varepsilon > 0 \\ 0, & \varepsilon = 0 \\ -1, & \varepsilon < 0, \end{cases}$$

Figure 6B:
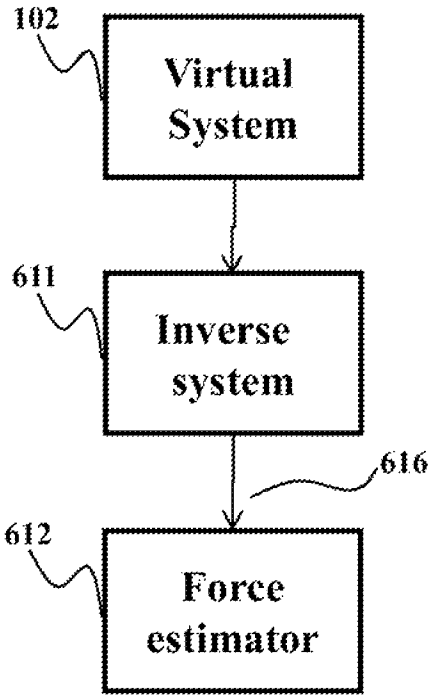
FIGS. 6A, 6B, 6C and 6D are block diagrams of estimating amplitude according to various embodiments of the invention.
Figure 6A:
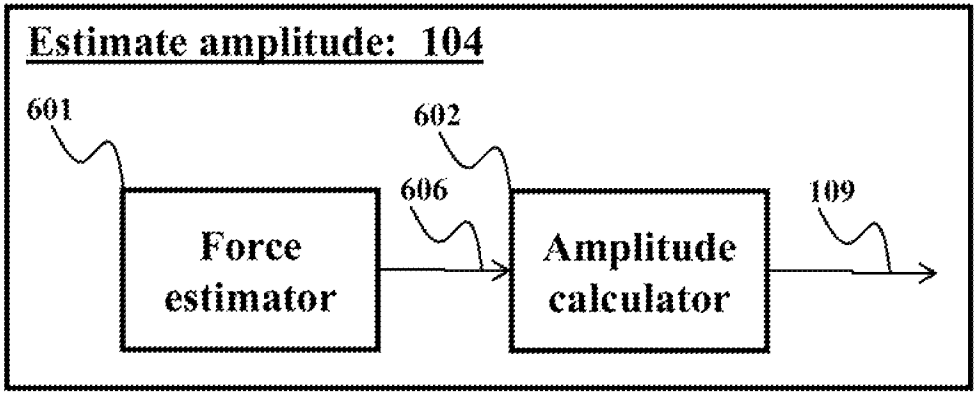

FIG. 6A shows a schematic of a method for determining the amplitude of the virtual force. A force estimator 601 outputs a time profile of the virtual force 606 to a block amplitude calculator 602, which estimates the amplitude of the virtual force by, e.g., solving an constrained optimization problem or linear regression problem.

FIG. 6B shows a block diagram of a method for designing the force estimator 601. The method starts with the model of the virtual system 102, which includes the virtual disturbance and its time derivative from the virtual disturbance block 106 as known input functions, the virtual force of the virtual semi-active actuator as an unknown input, and the measured acceleration signal as its output. The virtual system has only one unknown input: the virtual force. A transfer function, from the virtual force to the measured acceleration signals, of the virtual system, computed by applying a Laplace transformation to the virtual system, can be computed. The virtual system is inverted to produce an inverse system 611, which represents a system whose input is the measured acceleration signal and output is the virtual force.

In one embodiment, the inverse system uses a transfer function which is the same as the inverse of the transfer function from the virtual force to the measured acceleration signals. In one embodiment, given the transfer function of the inverse system, the force estimator 612 is implemented as a linear time invariant system having the same transfer function as the inverse system. The input of the force estimator is the acceleration signal and its output is the estimated virtual force. The estimated virtual force exponentially converges to the true virtual disturbance.

The estimated virtual force 606 may be noise corrupted thus an amplitude calculator 602 is used to post-process the estimated virtual force 606 to produce a good estimation of the amplitude 109. In one embodiment, the estimated virtual disturbance is parameterized as a linear function of the amplitude as follows $$F(t) = a\,\mathrm{sgn}(F(t)) + e(t),$$

where F(i) denotes the estimated virtual force, a denotes the amplitude of the virtual force and is constant, and e(t) is a white noise. Amplitude calculator tries to solve the amplitude a, and sgn( ) is a sign function extracting a sign of a real number.

Figure 6D:
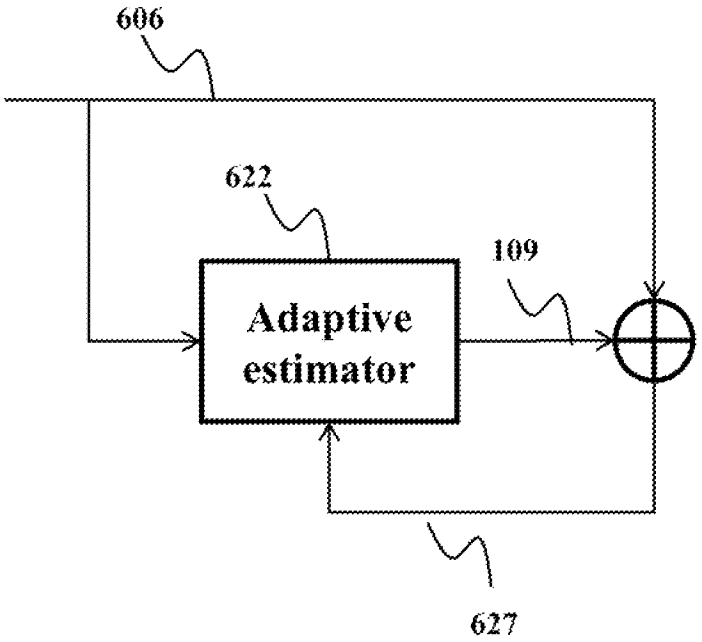
Figure 6C:
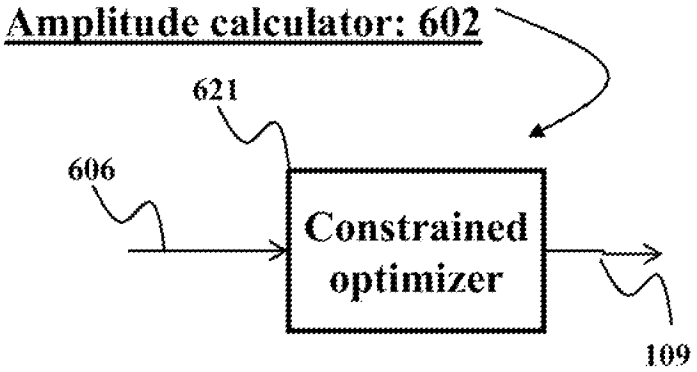

FIG. 6C shows an implementation of amplitude calculator 602 according to one embodiment that solves a constrained optimization problem $$\min_a \int_0^T (F(t) - a\,\mathrm{sgn}(F(t)))^2\,dt$$

$$|a| <= \varepsilon_1$$

where $\epsilon_1$ is a positive constant characterizing the maximal force of the virtual semi-active actuator, and T is the final time of the virtual force, min is a minimum value of a function. Since sgn(F(t)) is known, the constrained optimization problem has a unique solution. Embodiment presented in FIG. 6C computes the amplitude of the virtual force by offline optimization, which is not necessary, for instance, a moving horizon estimation.

FIG. 6D shows an implementation of amplitude calculator 602 according to another embodiment where the estimated virtual force is parameterized as $$F(t) = a\,\mathrm{sgn}(F(t)).$$

An adaptive estimator 622 is defined by the following differential equation $$\dot{\hat{a}} = \epsilon_2(F(t) - \hat{a}\,\mathrm{sgn}(F(t))) \tag{13}$$

where á is an estimation of the amplitude of the virtual force, and $\epsilon_2$ is a positive constant. A number of variants of differential equation (13) can be implemented as embodiments of the adaptive estimator 622. The adaptive estimator determines the amplitude of a virtual force 109 recursively 627.

Figure 7A:
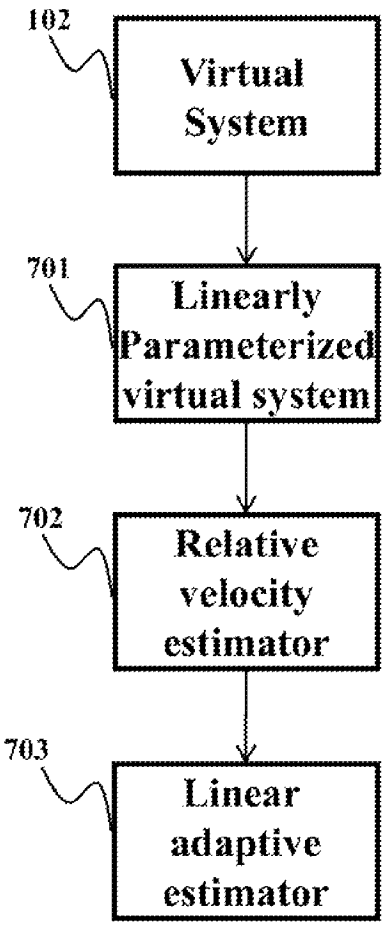
FIGS. 7A, 7B and 7C are block diagrams of estimating amplitude according to some embodiments of the invention.

FIG. 7A shows a block diagram of another method for implementing the estimate amplitude module 104. The method starts with the virtual system 102, which has only one unknown input: the virtual force. The virtual system is first rearranged into a linearly parameterized virtual system comprising of (8*), (10*), (11*), (12*), and (14) as $$T_u^x = a\,\mathrm{sgn}(\dot{\theta}_r^y), \tag{14}$$

where both a and $\mathrm{sgn}(\dot{\theta}_r^y)$ are unknown. In one embodiment, $\mathrm{sgn}(\dot{\theta}_r^y)$ can be estimated, and thus treated as known function. In this embodiment, the virtual system is linearly parameterized by unknown constant a. Given the linearly parameterized virtual system 701, a relative velocity estimator 702 is first determined to produce an estimation of a sign of the virtual relative velocity $\dot{\theta}_r^y$, then a linear adaptive estimator 703 is designed to produce the estimation of the amplitude of the virtual force.

Figure 7B:
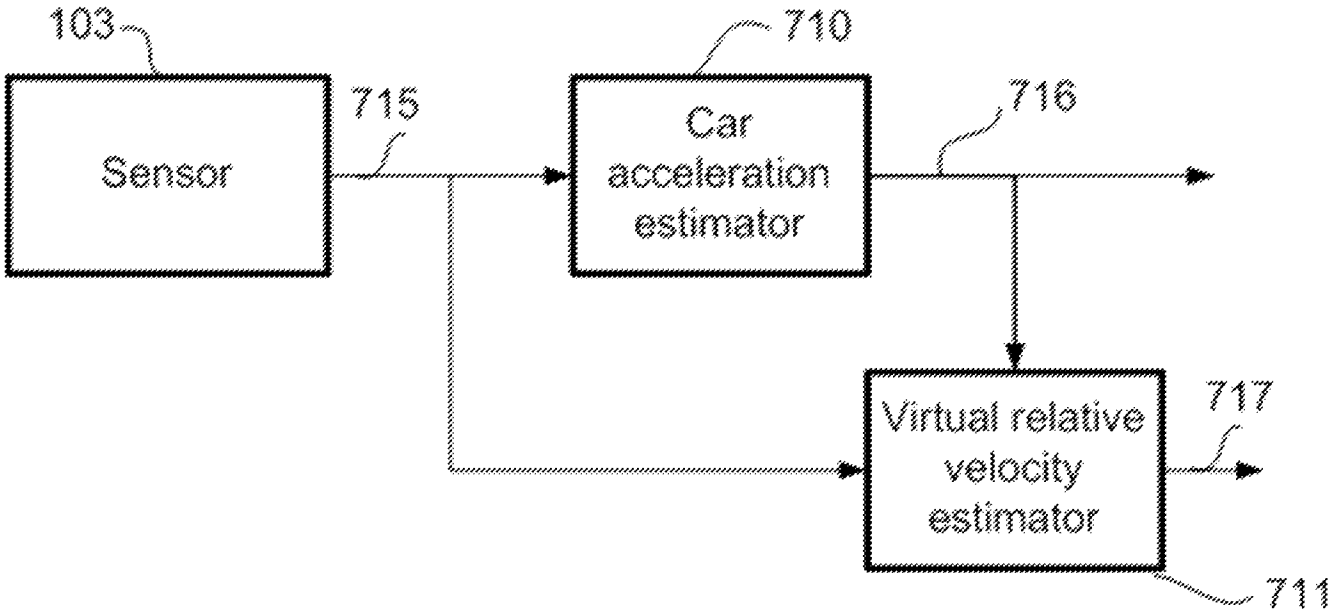

FIG. 7B shows a block diagram of a relative velocity estimator 702 according to one embodiment. The relative velocity estimator includes a car acceleration estimator 710, which produces an estimated car acceleration based on acceleration signals 715, and a virtual relative velocity estimator 711 which produces an estimated virtual relative velocity as $$\dot{\hat{\theta}}_r^y(t) = \hat{w}^x(t) - \dot{\hat{x}}_f(t),$$

where $\hat{w}^x$ denotes an estimated virtual disturbance, and $\hat{x}_f$ denotes an estimated translational displacement of the frame along the right-to-left direction.

In one embodiment, four semi-active actuators are installed on all four center rollers to minimize the vibration in the x-axis. This embodiment designs the virtual relative velocity estimator on the basis of the virtual system. Assuming that the semi-active actuators perform the same action, the model of the virtual relative position, denoted by $$\eta = \sum_{i=1}^{4} \theta_r^{yi},$$

is given by $$T_g^x + I_r^y\ddot{\eta} + (h_1^2 b_r^x + L^2 u^x)\dot{\eta} + h_1^2 k_r^x \eta = 0, \tag{15}$$

where $u^x = u_i^x$ for $1 \le i \le 4$ is the controlled damping coefficient of the virtual semi-active actuator. The dynamics of the virtual relative position is described by a linear time varying differential equation depending on the virtual relative position, the virtual relative velocity, the virtual control, and the torque from the roller gum $T_g^x$. Given the variable $T_g^x$ known and the dynamics of the virtual relative position (13), the virtual relative velocity estimator is determined as follows $$\dot{\hat{\eta}}_1 = \hat{\eta}_2,$$

$$\dot{\hat{\eta}}_2 = -\frac{1}{I_r^y}[(L^2 u^y + h_1^2 b_1)\hat{\eta}_2 + h_1^2 k_1 \hat{\eta}_1] - \frac{1}{I_r^y} T_g^x,$$

$$z_1 = \hat{\eta}_1,$$

$$z_2 = \hat{\eta}_2,$$

wherein $z_1$ denotes the estimated virtual relative position, $z_2$ denotes the estimated virtual relative velocity, $I_r^y$ is an inertial of a rotation arm with respect to a pivot, L is a length between the pivot and an actuator force point, $u^y$ is a viscous damping coefficient of the virtual semi-active actuator, $h_1$ is a height between the pivot and a roller spring, $b_1$ is a damping coefficient of the roller spring, $k_1$ is a stiffness of the roller spring, and $T_g^x$ represents a torque around the pivot. The output $z_2$ approximates the virtual relative velocity $\dot{\theta}_r^y$. The estimated virtual relative velocity $z_2$ converges exponentially to the true virtual relative velocity $\dot{\theta}_r^y$. The approximate value of the virtual relative position $z_1$ converges exponentially to the true value of the virtual relative position $\theta_r^y$.

In another embodiment, only two semi-active actuators are installed on two out of four center rollers to minimize the vibration in the x-axis. This embodiment designs the second filter on the basis of the virtual system, and the second filter is similar to the filter of the previous embodiment.

The value of $T_g^x$ can be obtained by using the output of the car acceleration estimator. For example, one embodiment assumes that translational and angular accelerations of the frame are measured. The car dynamics in Equations (8)-(9) are rearranged to estimate the car accelerations from the measured frame accelerations $$m_c\ddot{x}_c + k_c^x(x_c + l_c^y\theta_c^y) + b_c^x(\dot{x}_c + l_c^y\dot{\theta}_c^y) = k_c^x(x_f + l_c^y\theta_f^y) + b_c^x(\dot{x}_f + l_c^y\dot{\theta}_f^y),$$

$$I_c^y\ddot{\theta}_c^y + l_c^y k_c^x(x_c + l_c^y\theta_c^y) + l_c^y b_c^x(\dot{x}_c + l_c^y\dot{\theta}_c^y) = l_c^y k_c^x(x_f + l_c^y\theta_f^y) + l_c^y b_c^x(\dot{x}_f + l_c^y\dot{\theta}_f^y). \tag{16}$$

The Laplace transformation of Equation (16) is $$(M_c s^2 + B_c s + K_c)X_c(s) = (B_c s + K_c)X_f(s),$$

where $X_c(s) = [x_c(s), \theta_c^y(s)]$ is the Laplace transformation of $[x_c, \theta_c^y]$, and $X_f(s) = [x_c(s), \theta_c^y(s)]$ is the Laplace transformation of $[x_c, \theta_c^y]$, and $M_c$, $B_c$, $K_c$ are appropriate matrices. The car accelerations can be estimated by filtering the frame accelerations through the following first filter whose transfer function is given by $$G_c(s) = (M_c s^2 + B_c s + K_c)^{-1}(B_c s + K_c).$$

According to the estimation of the car accelerations, the value of the lumped force $f_c^x$ is known. Thus the value of the lumped force from the roller gum $f_g^x$ can be computed according to (10), which implies the value of the torque $T_g^x$. Thus the virtual relative velocity estimator is designed.

One embodiment further simplifies the estimation of the value of the torque $T_g^x$ This embodiment only measures the translational acceleration of the frame, e.g., in right-to-left direction. As disclosed above, the estimation of the acceleration of the elevator car in x-axis requires the knowledge of frame's translational acceleration in x axis and rotational acceleration around y axis. The rotational dynamics of the car and the frame can be decoupled from the translational dynamics due to its negligible effect, and Equation (16) is simplified as $$m_c\ddot{x}_c + k_c^x x_c + b_c^x\dot{x}_c = k_c^x x_f + b_c^x\dot{x}_f. \tag{17}$$

From the dynamics of Equation (17), the car acceleration in x axis can be estimated as the output of the following car acceleration estimator whose input is the frame acceleration in x axis $$G(s) = \frac{b_c^x s + k_c^x}{m_c s^2 + b_c^x s + k_c^x}.$$

The G(s) is the transfer function of the car acceleration estimator whose input is translational acceleration of the elevator frame in, e.g., right to left direction, and the output is the estimated translational acceleration of the elevator car in, e.g., right to left direction. Also, s is a complex frequency, $m_c$ is a mass of the elevator car, $k_c^x$ is a weighted stiffness of a car-hold dumper, and $b_c^x$ is a weighted damping of car-hold dumper. Given the estimated car acceleration, the value of the lumped force from the roller gum $f_g^x$ can be computed according to Equation (10), which implies the value of the torque $T_g^x$. The virtual relative velocity can be approximated by the same virtual relative velocity estimator. Accordingly, the vibration of the elevator car is minimized based only on the measurement of the acceleration.

Figure 7C:
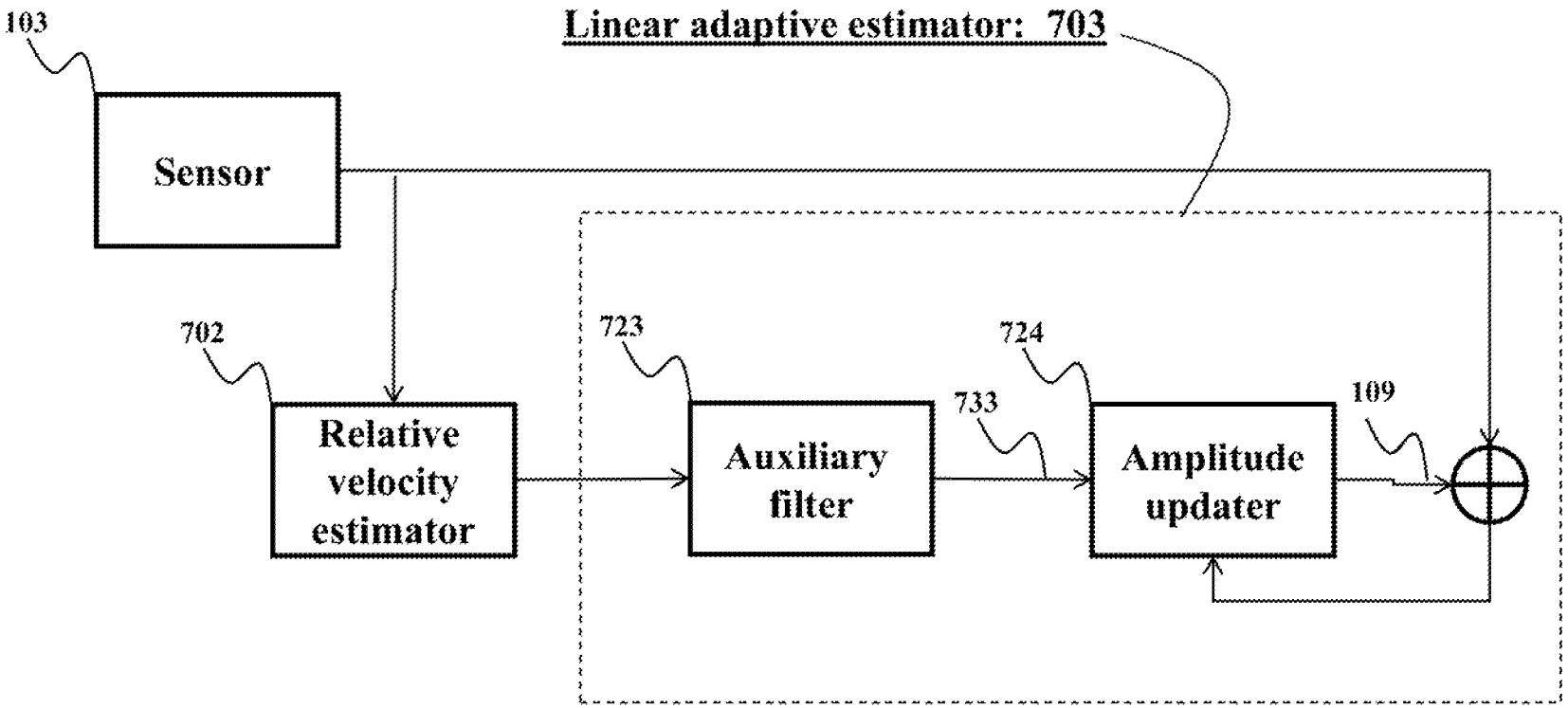

FIG. 7C shows a schematic of the linear adaptive estimator 703, which produces the estimated amplitude of the virtual force using an auxiliary filter 723 and an amplitude updater 724. In one embodiment, the auxiliary filter 723 is $$\dot{\alpha}=(Q-LC)\alpha+B_1\,\mathrm{sgn}(\hat{\dot{\theta}}_r^y),$$

where $\alpha$ is an auxiliary signal, L is a constant gain matrix to ensure all eigenvalues of Q−LC are located in the left half complex plane. The amplitude updater is given by the following differential equation $$\dot{\hat{a}}=-k\alpha^T(y-\hat{y}),$$

$$\dot{\hat{x}}=Q\hat{x}+L(y-\hat{y})+B_1\,\mathrm{sgn}(\hat{\dot{\theta}}_r^y)-k\alpha\alpha T(y-\hat{y}),$$

and $$\hat{y}=C\hat{x}+D_1\,\mathrm{sgn}(\hat{\dot{\theta}}_r^y)+D_2(t).$$

Determining Virtual Disturbance

Figure 8:
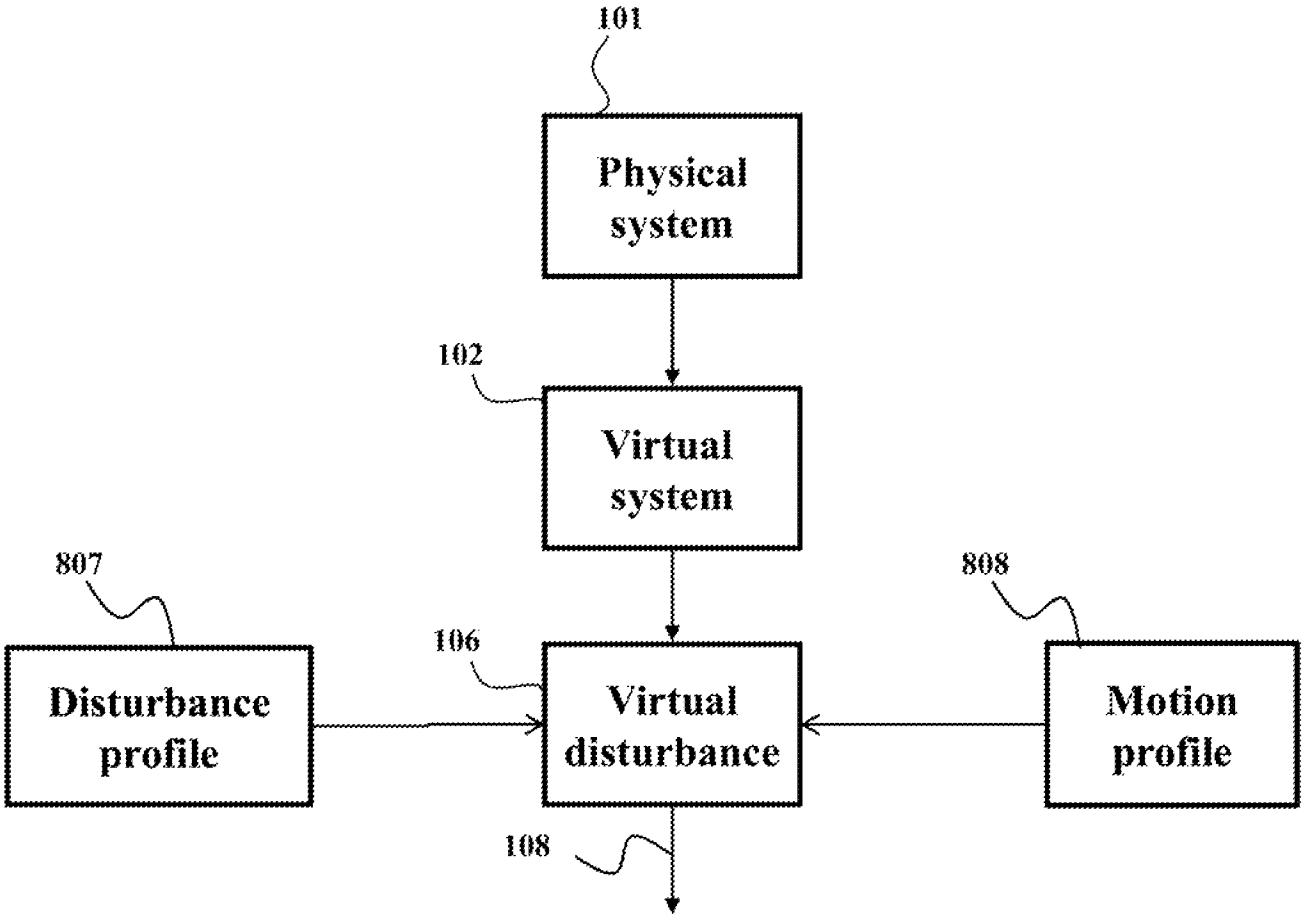
FIG. 8 is a block of a method for determining virtual disturbance based on disturbance profile according to some embodiments of the invention.

FIG. 8 shows a block diagram for determining virtual disturbance 108. Given the model of the virtual system 102, a pre-determined disturbance profile 807, a motion profile 808, a disturbance module 106 determines a virtual disturbance 109 of the virtual system. The disturbance profile 807 is determined offline and stored in memory for online use to reconstruct the virtual disturbance 108 corresponding to a real operation of the physical system. The motion profile 808 of a position of the elevator car can be, e.g., determined by a motion controller of the elevator system. Such embodiment can be advantageous because allows to incorporate future disturbance in the control policy.

Figure 9A:
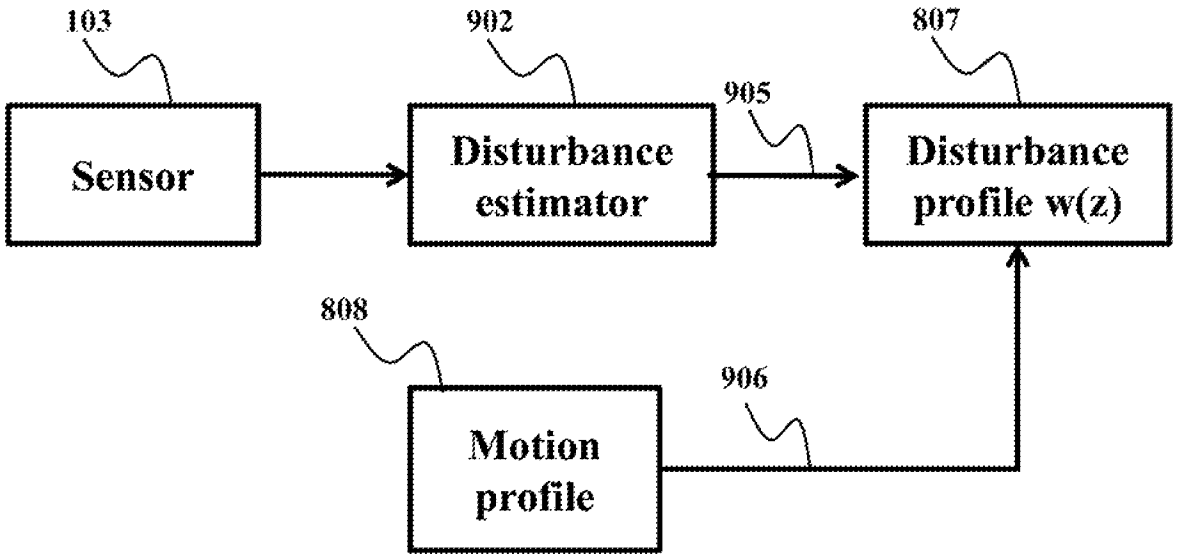
FIGS. 9A, 9B, 9C, 9D and 9E are block diagrams of various methods for determining a disturbance profile.

FIG. 9A shows a schematic of a method 900 for determining the disturbance profile 807 according to one embodiment of the invention. The method 900 can be performed offline by running the elevator at least once. The elevator system can be operated without the actuators 112. The sensor 103 outputs the measured signal, e.g., acceleration, to a disturbance estimator 902, which produces an estimated disturbance 905 as a function of time. A motion profile 808 outputs a vertical position trajectory 906 defining the position of the elevator car as a function of time. The trajectory 906 can be combined with the estimated disturbance 905 to produce the disturbance profile 807 as a function of vertical position. The disturbance profile block 807 determines the virtual disturbance profile based on the virtual disturbance in time domain and the map between time and the vertical position as determined by the motion profile.

Figure 9B:
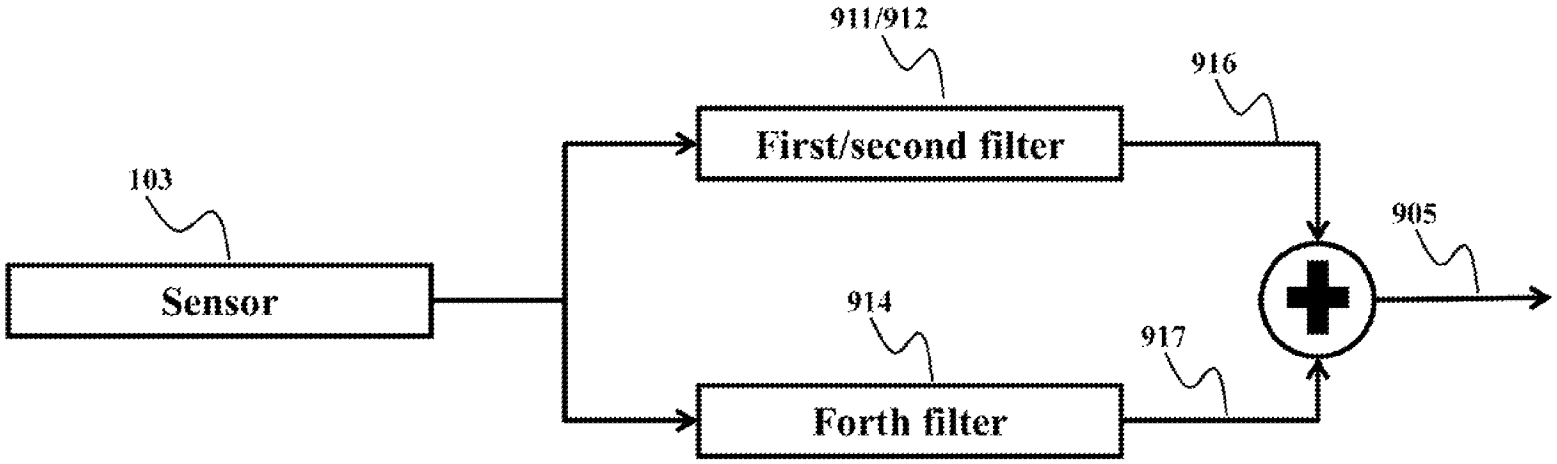
Figure 9C:
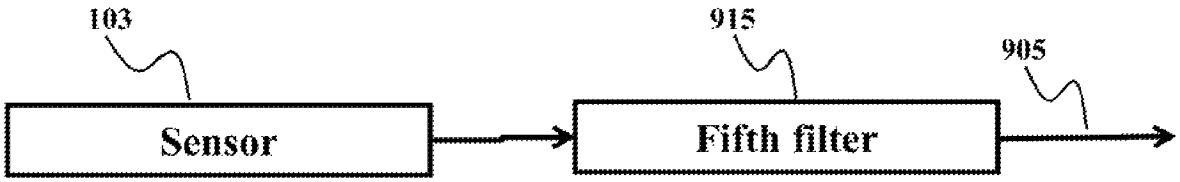

FIGS. 9B and 9C illustrate two embodiments of implementation of the disturbance estimator 902. Both embodiments only require accelerometers as sensors. In the embodiment shown in FIG. 9B, the sensor 103 outputs the frame's translational acceleration in right-to-left direction to a first filter 911, a second filter 912, and a forth filter 914. The first and second filters process the acceleration signal and produce the estimated virtual relative position 916 between two ends of the virtual actuator. Example of the virtual relative position can formulated as $$\hat{\theta}_r^y(t)=\hat{w}^x(t)-\hat{x}_f(t),$$

where $\hat{w}^x$ denotes an estimated virtual disturbance, and $\hat{x}_f$ denotes an estimated translational displacement of the frame along the right-to-left direction. The forth filter processes the acceleration signal to produce the estimated translational displacement 917, of the frame along the right-to-left direction $\hat{x}_f$. Summation of signals 916 and 917 gives the estimated virtual disturbance $\hat{w}^x$.

FIG. 9C shows the embodiment processing the acceleration signal using a fifth filter 915 to produce the estimated virtual disturbance $\hat{w}^x$ directly. The estimated virtual disturbance, combined with the vertical position profile, is mapped into the virtual disturbance profile. Examples of various implementations of the filters are described in more details below.

Figure 9D:
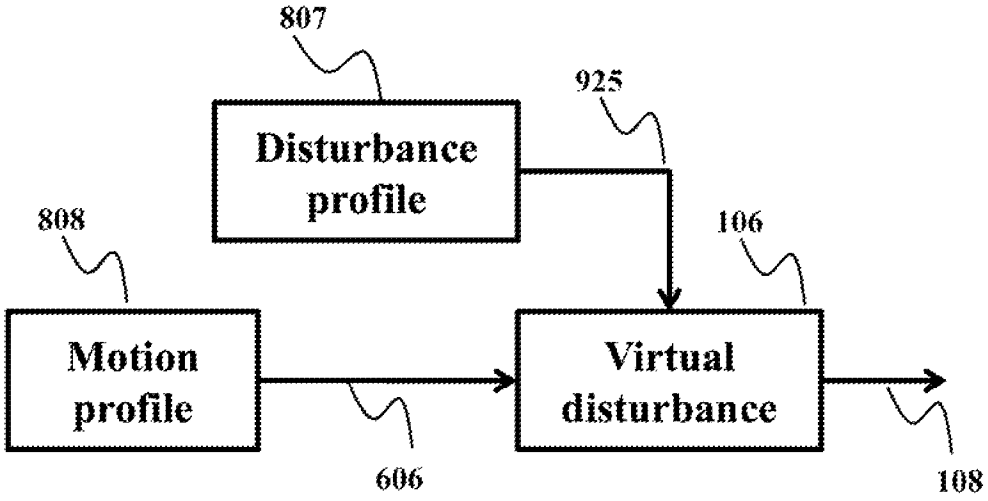
Figure 9E:
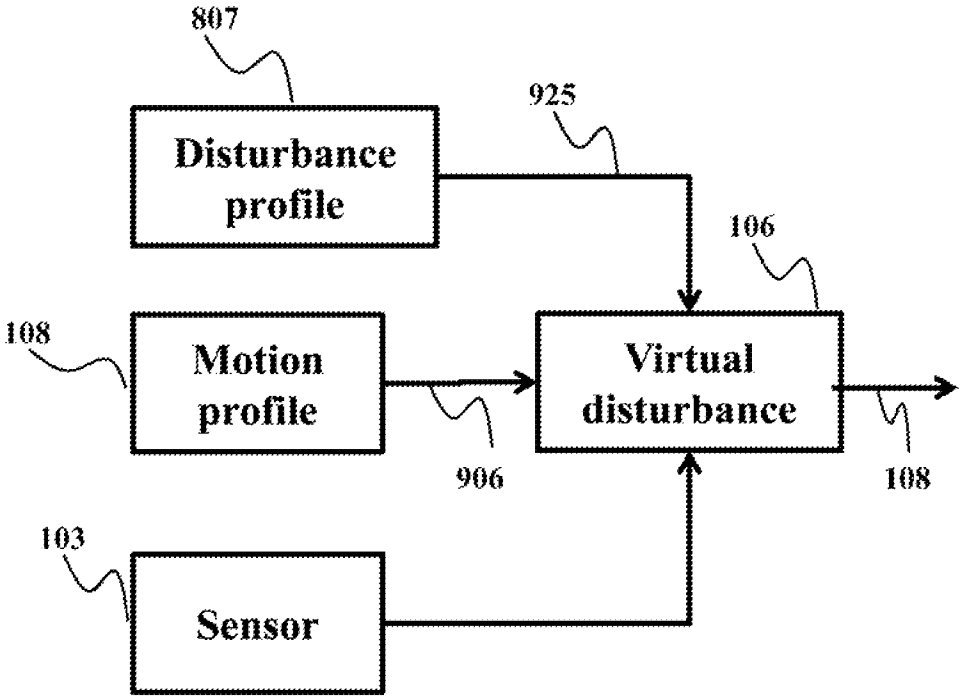

FIGS. 9D-9E shows block diagrams of methods for determining the virtual disturbance for each operation of the elevator. The virtual disturbance can be different for different operations, e.g., for different trips of the elevator car. Advantageously, various embodiments of the invention can address various disturbances of the elevator system including, but not limited to, the deformation of the guide rails.

In one embodiment shown in FIG. 9D, given the virtual disturbance profile 925 provided by the disturbance profile block 807, and the vertical position trajectory 906 for a trip of the elevator car determined before the operation of the elevator system, the virtual disturbance 108 during the entire period of the operation can be determined before the trip. The vertical position trajectory 906 is determined by a motion profile 808, which could be a motion planner for the elevator case.

FIG. 9E shows a diagram of another embodiment, in which the acceleration signal from sensor 103 are used to preview the disturbance over the entire period of each operation of the elevator, and to correct the virtual disturbance real-time. The vertical position trajectory 906 is used to preview the virtual disturbance over the entire period of each operation before the elevator runs the operation, whereas the acceleration signal from sensor 103 is used to update the vertical position trajectory 906 to improve the accuracy of the vertical position trajectory while the elevator runs the operation, thus corrects the virtual disturbance over the rest operation time.

FIG. 7B show one embodiment of the first/second filters 911/912, where the car acceleration estimator block 710 is one embodiment of the first filter 911, and the virtual relative position estimator block 711 is one embodiment of the second filter 912. Note the virtual relative velocity estimator 717 or the second filter 912 can produce the virtual relative position estimation as well as the virtual relative velocity estimator.

Figure 10A:
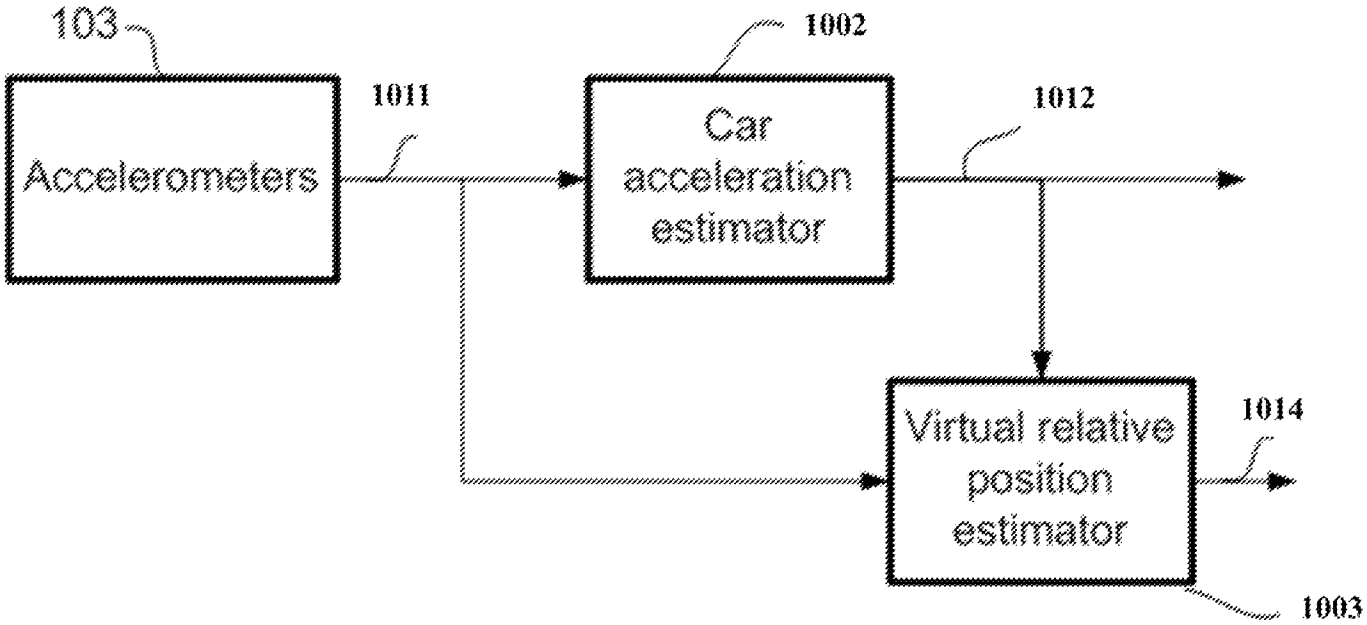
FIGS. 10A, 10B and 10C are block diagrams for an estimator used for the elevator system to reconstruct the virtual disturbance according to various embodiments of the invention.
Figure 10C:
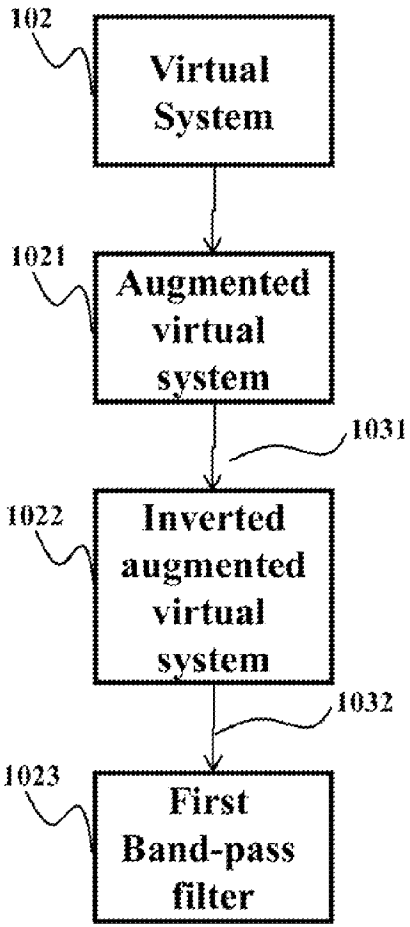
Figure 10B:
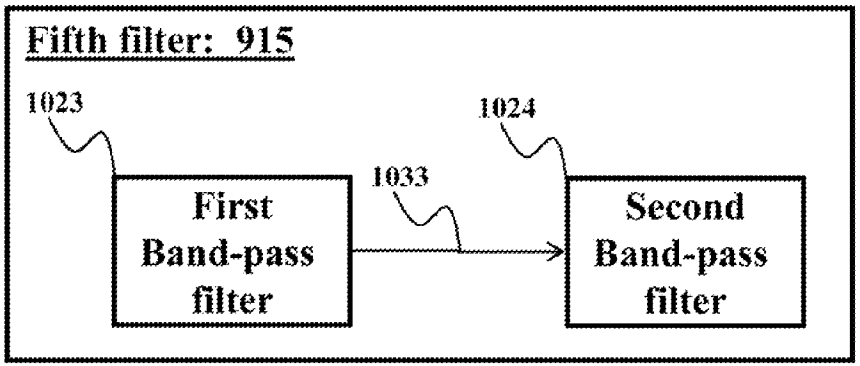

FIGS. 10A and 10B show the schematic of the fifth filter 915, and the procedure to design a first band-pass filter 1023 of the fifth filter 915. FIG. 10A shows that the first band-pass filter 1023 processes the input signal, typically acceleration signals, and output a signal 1033 representing the second order time derivative of the virtual disturbance, then a second band-pass filter 1024 processes the signal 1033 to produce the estimated virtual disturbance as the output of the fifth filter.

FIG. 10B illustrates procedure method for designing the first band-pass filter. The methods start with the model of the virtual system 102, which include the virtual disturbance and its time derivative as unknown functions. The model of the virtual system originally includes state variables describing the movement of the elevator frame, car, and the virtual roller guide assembly, and is augmented by including the virtual disturbance and its time derivative as two extra state variables to produce an augmented virtual system 1021, which is given by $$m_c\ddot{x}_c+f_c^x=0, \tag{18}$$

$$(m_f+m_r)\ddot{x}_f-f_c^x+f_g^x=0, \tag{19}$$

$$I_r^y\ddot{\theta}_r^y+T_g^x+T_r^x+T_u^x=0, \tag{20}$$

$$\dot{\xi}_7=\xi_8,$$

$$\xi_8=v \tag{21}$$

$$y=\ddot{x}_f, \tag{22}$$

where $\xi_7$, $\xi_8$ represent the virtual disturbance and its time derivative respectively, and v represents the second order time derivative of the virtual disturbance. The augmented virtual system has only one unknown external input function v: the second order time derivative of the virtual disturbance.

In one embodiment, the virtual semi-active actuator is switched off, and the augmented virtual system is linear time invariant. A transfer function of the augmented virtual system, denoted by $$G_{vy}=\frac{Y(s)}{V(s)}$$

can be computed by applying the Laplace transformation to the input v and output y of the augmented virtual system, has zero-poles cancellation, after which all zeros and poles are located at the left half complex plane. The augmented virtual system is invertible, thus is inverted to produce an inverted augmented virtual system 1022 whose transfer function is given by $$G_{inv}=\frac{1}{G_{vy}}.$$

Based on the inverted augmented virtual system, the first band-pass filter can be determined as a copy of the inverted augmented virtual system whose input is the measured acceleration signal, and the output is the estimated second order time derivative of the virtual disturbance 1033.

A copy of the inverted augmented virtual system means that the first band-pass filter has the exactly the same transfer function as the inverted augmented virtual system. The estimated second order time derivative of the virtual disturbance 733 exponentially converges to the second order time derivative of the virtual disturbance.

The second band-pass filter is designed to approximate a double integrator such that the estimated virtual disturbance can be reliably reconstructed from the estimated second order time derivative of the virtual disturbance 733. The design of the second band-pass filter to approximate a double integrator is straightforward for those skilled in the art. The method to design the first band-pass filter relies on Laplace transformation of the augmented virtual system which has to be linear time invariant. The transfer function of the augmented virtual system may not exist if the virtual semi-active actuator is switched ON and OFF over time, which means the augmented virtual system is time varying. In this case, the method according to one embodiment does not use of transfer function. Instead, the model of the virtual semi-active actuator is used, such that the compensative force generated by the virtual semi-active is a known signal and its effect on the output are removed to produce a new output which only depends on the virtual disturbance.

For example, by treating the compensative force F(t) of the virtual semi-active actuator as a known input, the augmented virtual system is linear time invariant and the Laplace transformation of its output is given by $$Y(s)=G_{vy}(s)V(s)+G_{yu}(s)F(s),$$

where F(s) is the Laplace transformation of the compensative force of the virtual semi-active actuator, and $G_{yu}$ is the transfer function from the compensative force to the output. One can redefine a new output $\bar{y}$ whose transfer function is given by $\bar{Y}(s)=Y(s)-G_{yu}F(s)$ and its time domain profile can be accordingly reconstructed. Letting the new output $\bar{y}$ as the input of the fifth filter gives the estimated second order time derivative of the virtual disturbance.

Some embodiments are based on a realization that it is beneficial to first operate the elevator with semi-active actuators in the OFF position such that the virtual system is subject to forces due to the virtual disturbance only, and the Laplace transformation of the augmented virtual system is always possible. This embodiment minimizes difficulty of dealing with various uncertainties simultaneously. Letting the semi-active actuators in ON position however does not prevent the application of the method.

Figure 11:
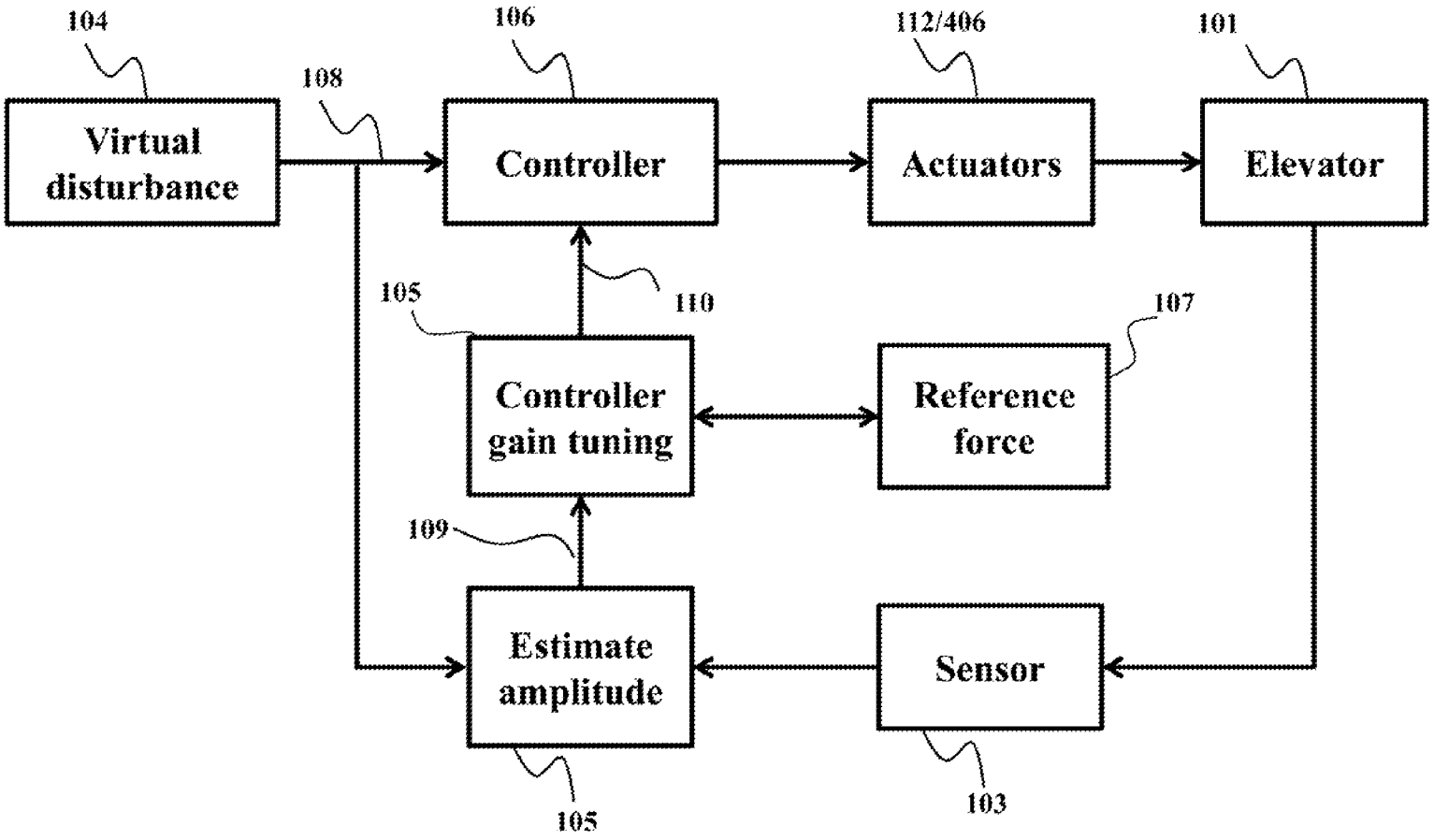
FIG. 11 is a block diagram of the elevator control system according to some embodiments of the invention.

FIG. 11 shows a block diagram for controlling a set of semi-active actuators according to one embodiment of the invention. Sensors 103 measure a signal indicating an operational status of the elevator system 101. The controller 106 determines a state of the elevator system using the model of the virtual elevator system, the virtual disturbance 108 determined by the virtual disturbance module 104, and the signal measured by the sensors 103. The controller 106 controls each actuator of the set of semi-active actuators based on the state of the elevator system and according to a control policy of the virtual semi-active actuator. The control signal generated by the controller can vary either the voltage or current of semi-active actuators. The signal can be directly outputted to the semi-active actuators 112, or indirectly via amplifiers.

A controller gain tuning block 105 determines a controller gain 110 based on the amplitude of the reference virtual force 107 and the amplitude 109 of the estimated virtual force 105, and outputs the controller gain 110 to the controller 106. The gain 110 can also be used updating the reference force 107 for subsequent iterations of the method 100.

The embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Further, it should be appreciated that a computer may be embodied in any of a number of forms, such as a rack-mounted computer, a desktop computer, a laptop computer, minicomputer, or a tablet computer. Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the invention may be embodied as a non-transitory computer-readable medium or multiple computer readable media. The terms "program" or "software" are used herein in a generic sense to refer to any type of computer code or set of computer-executable instructions that can be employed to program a computer or other processor to implement various aspects of the present invention as discussed above.

Computer-executable instructions may be in many forms, such as program modules, executed by one or more computers or other devices. Generally, program modules include routines, programs, objects, components, data structures that perform particular tasks or implement particular abstract data types. Typically the functionality of the program modules may be combined or distributed as desired in various embodiments.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

We claim:

1. A method for controlling a set of semi-active actuators arranged in an elevator system to minimize a vibration of an elevator car caused by a set of disturbances in a horizontal direction on the elevator car moving, in a vertical direction, comprising:

representing the elevator system with a model of a virtual elevator system having a single virtual semi-active actuator arranged to compensate a virtual disturbance proportional to a sum of disturbances from the set of disturbances, wherein a compensative, force of the virtual semi-active actuator is proportional to a sum of compensative forces of the set of semi-active actuators;

determining the virtual disturbance during an operation of the elevator car using a motion profile of position of the elevator car during the operation and a disturbance profile of the virtual disturbance;

determining an amplitude of an virtual force of the virtual semi-active actuator using the model and the virtual disturbance; and adjusting a gain of a controller for controlling the set of semi-active actuators based on the amplitude of the virtual force and a reference force of the virtual semi-active actuator, wherein steps of the method are performed by a processor.

2. The method of claim 1, wherein the determining the amplitude further comprises:

determining an inverse system based on the virtual elevator system;

designing a force estimator based on the inverse system, wherein the force estimator takes as an input an acceleration signal and outputs the virtual force; and determining the virtual force using the force estimator in response to measuring the acceleration signal.

3. The method of claim 2, wherein t le determining the amplitude further comprises:

reformulating the virtual system model by treating a virtual force of the virtual semi-active actuator as an input;

determining a transfer function between the virtual force and the acceleration signal; and inversing the transfer function to produce a transfer function of the inverse system.

4. The method of claim 2, wherein the determining the amplitude further comprises:

solving a constrained optimization problem offline.

5. The method of claim 2, wherein the determining the amplitude uses an online adaptive estimator for a linear regression problem.

6. The method of claim 1, further comprising:

adjusting gain for controlling the virtual semi-active actuator to produce the reference force.

7. The method of claim 1, further comprising:

receiving acceleration values of an acceleration signal measured at different vertical positions of the elevator car during an operation of the elevator system without a usage of the set of actuators, wherein the operation is according to a vertical position trajectory; and determining, based on the model and the acceleration values, the disturbance profile of the virtual disturbance.

8. The method of claim 7, further comprising:

augmenting the model with the virtual disturbance and a time derivative of the virtual disturbance as state variables to produce an augmented model;

inverting the augmented model to determine a relationship between a second order time derivative of the virtual disturbance and the acceleration signal;

determining, using the relationship, the second order time derivative of the virtual disturbance for each acceleration value of the acceleration signal;

integrating twice the second order time derivative to produce a value of the virtual disturbance forming a time profile of the virtual disturbance; and producing the disturbance profile of the virtual disturbance based on the time profile of the virtual disturbance and the vertical position trajectory.

9. The method of claim 8, further comprising defining an estimator with a transfer function as the inverse of the transfer function from the second order time derivative of the virtual disturbance to the acceleration signal;

operating the elevator system without using t le set of actuators to produce the acceleration signal; and determining the second order time derivative of the virtual disturbance as an output of the estimator processing the acceleration signal.

10. The method of claim 7, further comprising:

determining a relative position between two ends of the virtual semi-active actuator based on the acceleration signal;

determining a horizontal, displacement of the elevator car based on the acceleration signal; and summing the relative position and the horizontal displacement to produce a time profile of the virtual disturbance; and producing, the disturbance profile using the time profile of the virtual disturbance and the vertical position trajectory.

11. The method of claim 1, further comprising:

parameterizing the virtual force as a product of an unknown amplitude and a sign of a virtual relative velocity;

designing an amplitude estimator based on the virtual system, the sign of the virtual relative velocity, and an acceleration signal; and determining the virtual force using the amplitude estimator in response to measuring the acceleration signal.

12. A system for controlling a set of semi-active actuators arranged in an elevator system to compensate for a set of disturbances, comprising:

a sensor for determining an acceleration signal indicative of a horizontal acceleration of the elevator car during an operation of the elevator system;

a virtual disturbance module for determining a virtual disturbance using a motion profile of position of an elevator car during an operation of the elevator system and a disturbance profile of the virtual disturbance;

a controller for controlling each actuator of the set of semi-active actuators according to a control policy of the virtual semi-active actuator using the disturbance profile of the virtual disturbance and the acceleration signal measured during the operation of the elevator car with usage of the set of actuators;

an amplitude estimator for determining an amplitude of an virtual force of the virtual semi-active actuator using the model and the virtual disturbance; and a tuning module for adjusting a gain of a controller for controlling the set of semi-active actuators based on the amplitude of the virtual force and a reference force of the virtual semi-active actuator.

13. The system of claim 12, wherein the aptitude estimator comprises:

a relative velocity estimator to produce an estimated virtual relative velocity and a linear adaptive estimator to produce the amplitude.

14. The system of claim 13, wherein the linear adaptive estimator comprises:

an auxiliary filter to produce an auxiliary signal for amplitude estimation; and an amplitude updater to produce the estimated amplitude.

15. The system of claim 13, wherein the relative velocity estimator comprises:

a car acceleration estimator to produce an estimated acceleration of an elevator car based an the virtual system and acceleration signals; and a virtual relative velocity estimator to produce the estimated virtual relative velocity based on the virtual system, the estimated acceleration of the elevator car, and the acceleration signals.

16. The system of claim 15, wherein the amplitude estimator updates the estimated parameter based on the auxiliary signal and an innovation signal.

* * * * *